US008951109B2

(12) United States Patent
Arnone et al.

(10) Patent No.: US 8,951,109 B2
(45) Date of Patent: Feb. 10, 2015

(54) ENHANCED SLOT-MACHINE FOR CASINO APPLICATIONS

(71) Applicant: Gamblit Gaming, LLC, Glendale, AZ (US)

(72) Inventors: Miles Arnone, Sherborn, MA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/080,767

(22) Filed: Nov. 14, 2013

(65) Prior Publication Data

US 2014/0073405 A1 Mar. 13, 2014

Related U.S. Application Data

(63) Continuation of application No. 13/854,658, filed on Apr. 1, 2013, which is a continuation of application No. PCT/US2011/063587, filed on Dec. 6, 2011.

(60) Provisional application No. 61/459,131, filed on Dec. 6, 2010.

(51) Int. Cl.
*G07F 17/32* (2006.01)

(52) U.S. Cl.
USPC ..... 463/16; 463/20; 463/25; 463/29

(58) Field of Classification Search
USPC ..... 463/16, 20, 25, 29
See application file for complete search history.

(56) References Cited

U.S. PATENT DOCUMENTS

| | | | |
|---|---|---|---|
| 5,413,357 | A | 5/1995 | Schulze et al. |
| 5,709,603 | A | 1/1998 | Kaye |
| 5,718,429 | A | 2/1998 | Keller |
| 5,785,592 | A | 7/1998 | Jacobsen |
| 6,050,895 | A | 4/2000 | Luciano |
| 6,227,974 | B1 | 5/2001 | Eilat |
| 6,267,669 | B1 | 7/2001 | Luciano |
| 6,712,693 | B1 | 3/2004 | Hettinger |
| 6,761,632 | B2 | 7/2004 | Bansemer et al. |
| 6,761,633 | B2 | 7/2004 | Riendeau |
| 6,764,397 | B1 | 7/2004 | Robb |

(Continued)

FOREIGN PATENT DOCUMENTS

| | | | |
|---|---|---|---|
| JP | 2001300098 | A | 10/2001 |
| JP | 2003000944 | A | 1/2003 |

(Continued)

OTHER PUBLICATIONS

4GAMER.NET, Grand Fantasia—Ghost Story, www.4gamer.net, http://www.4gamer.net/games/084/6008493/20100730006/ , Japan.

(Continued)

*Primary Examiner* — Omkar Deodhar
(74) *Attorney, Agent, or Firm* — Dwight Kim

(57) ABSTRACT

Methods and apparatus for a gaming system are provided. The gaming system receives a request for a wager for a player of an entertainment game, the request being triggered by a player action taken by the player while playing the entertainment game. The gaming system establishes a result for the wager and generates, based on the result of the wager, a controlled sequence of a portion of the entertainment game, the controlled sequence changing the state of the entertainment game as the entertainment game is being played by the player.

21 Claims, 9 Drawing Sheets

(56) References Cited

U.S. PATENT DOCUMENTS

| | | | |
|---|---|---|---|
| 6,811,482 | B2 | 11/2004 | Letovsky |
| 7,118,105 | B2 | 10/2006 | Benevento |
| 7,294,058 | B1 | 11/2007 | Slomiany |
| 7,326,115 | B2 | 2/2008 | Baerlocher |
| 7,361,091 | B2 | 4/2008 | Letovsky |
| 7,517,282 | B1 | 4/2009 | Pryor |
| 7,575,517 | B2 | 8/2009 | Parham et al. |
| 7,682,239 | B2 | 3/2010 | Friedman et al. |
| 7,720,733 | B2 | 5/2010 | Jung |
| 7,753,770 | B2 | 7/2010 | Walker et al. |
| 7,753,790 | B2 | 7/2010 | Nguyen |
| 7,775,885 | B2 | 8/2010 | Van Luchene |
| 7,798,896 | B2 | 9/2010 | Katz |
| 7,828,657 | B2 | 11/2010 | Booth |
| 7,917,371 | B2 | 3/2011 | Jung et al. |
| 7,938,727 | B1 | 5/2011 | Konkle |
| 7,967,674 | B2 | 6/2011 | Baerlocher |
| 7,980,948 | B2 | 7/2011 | Rowe |
| 7,996,264 | B2 | 8/2011 | Kusumoto et al. |
| 8,012,023 | B2 | 9/2011 | Gates |
| 8,047,915 | B2 | 11/2011 | Lyle |
| 8,060,829 | B2 | 11/2011 | Jung et al. |
| 8,075,383 | B2 | 12/2011 | Friedman et al. |
| 8,087,999 | B2 | 1/2012 | Oberberger |
| 8,113,938 | B2 | 2/2012 | Friedman et al. |
| 8,118,654 | B1 | 2/2012 | Nicolas |
| 8,128,487 | B2 | 3/2012 | Hamilton et al. |
| 8,135,648 | B2 | 3/2012 | Oram |
| 8,137,193 | B1 | 3/2012 | Kelly et al. |
| 8,142,272 | B2 | 3/2012 | Walker et al. |
| 8,157,653 | B2 | 4/2012 | Buhr |
| 8,167,699 | B2 | 5/2012 | Inamura |
| 8,177,628 | B2 | 5/2012 | Manning |
| 8,182,338 | B2 | 5/2012 | Thomas |
| 8,182,339 | B2 | 5/2012 | Anderson |
| 8,187,068 | B2 | 5/2012 | Slomiany |
| 8,206,210 | B2 | 6/2012 | Walker |
| 8,475,266 | B2 | 7/2013 | Arnone et al. |
| 2001/0004609 | A1 | 6/2001 | Walker |
| 2001/0019965 | A1 | 9/2001 | Ochi |
| 2002/0022509 | A1 | 2/2002 | Nicastro |
| 2002/0090990 | A1 | 7/2002 | Joshi |
| 2002/0175471 | A1 | 11/2002 | Faith |
| 2003/0060286 | A1 | 3/2003 | Walker et al. |
| 2003/0119576 | A1 | 6/2003 | McClintic et al. |
| 2003/0139214 | A1 | 7/2003 | Wolf et al. |
| 2003/0171149 | A1 | 9/2003 | Rothschild |
| 2004/0092313 | A1 | 5/2004 | Saito et al. |
| 2004/0102238 | A1 | 5/2004 | Taylor |
| 2004/0121839 | A1 | 6/2004 | Webb |
| 2004/0225387 | A1 | 11/2004 | Smith |
| 2005/0003878 | A1 | 1/2005 | Updike |
| 2005/0096124 | A1 | 5/2005 | Stronach |
| 2005/0116411 | A1 | 6/2005 | Herrmann et al. |
| 2005/0192087 | A1 | 9/2005 | Friedman et al. |
| 2005/0233791 | A1 | 10/2005 | Kane |
| 2005/0239538 | A1 | 10/2005 | Dixon |
| 2005/0269778 | A1 | 12/2005 | Samberg |
| 2005/0288101 | A1 | 12/2005 | Lockton et al. |
| 2006/0003823 | A1 | 1/2006 | Zhang |
| 2006/0003830 | A1 | 1/2006 | Walker et al. |
| 2006/0040735 | A1 | 2/2006 | Baerlocher |
| 2006/0068913 | A1 | 3/2006 | Walker et al. |
| 2006/0084499 | A1 | 4/2006 | Moshal |
| 2006/0084505 | A1 | 4/2006 | Yoseloff |
| 2006/0135250 | A1 | 6/2006 | Rossides |
| 2006/0154710 | A1 | 7/2006 | Serafat |
| 2006/0166729 | A1 | 7/2006 | Saffari et al. |
| 2006/0189371 | A1 | 8/2006 | Walker et al. |
| 2006/0234791 | A1 | 10/2006 | Nguyen et al. |
| 2006/0258433 | A1 | 11/2006 | Finocchio et al. |
| 2007/0035548 | A1 | 2/2007 | Jung et al. |
| 2007/0038559 | A1 | 2/2007 | Jung et al. |
| 2007/0064074 | A1 | 3/2007 | Silverbrook et al. |
| 2007/0087799 | A1 | 4/2007 | Van Luchene |
| 2007/0093299 | A1 | 4/2007 | Bergeron |
| 2007/0117641 | A1 | 5/2007 | Walker et al. |
| 2007/0129149 | A1 | 6/2007 | Walker |
| 2007/0156509 | A1 | 7/2007 | Jung et al. |
| 2007/0167212 | A1 | 7/2007 | Nguyen |
| 2007/0167239 | A1 | 7/2007 | O'Rourke |
| 2007/0191104 | A1 | 8/2007 | Van Luchene |
| 2007/0203828 | A1 | 8/2007 | Jung et al. |
| 2007/0293306 | A1 | 12/2007 | Nee et al. |
| 2008/0004107 | A1 | 1/2008 | Nguyen et al. |
| 2008/0014835 | A1 | 1/2008 | Weston et al. |
| 2008/0015004 | A1 | 1/2008 | Gatto et al. |
| 2008/0070659 | A1 | 3/2008 | Naicker |
| 2008/0070690 | A1 | 3/2008 | Van Luchene |
| 2008/0070702 | A1 | 3/2008 | Kaminkow |
| 2008/0096665 | A1 | 4/2008 | Cohen |
| 2008/0108425 | A1 | 5/2008 | Oberberger |
| 2008/0119283 | A1 | 5/2008 | Baerlocher |
| 2008/0146308 | A1 | 6/2008 | Okada |
| 2008/0176619 | A1 | 7/2008 | Kelly |
| 2008/0191418 | A1 | 8/2008 | Lutnick et al. |
| 2008/0195481 | A1 | 8/2008 | Lutnick |
| 2008/0248850 | A1 | 10/2008 | Schugar |
| 2008/0254893 | A1 | 10/2008 | Patel |
| 2008/0274798 | A1 | 11/2008 | Walker et al. |
| 2008/0311980 | A1 | 12/2008 | Cannon |
| 2008/0318668 | A1 | 12/2008 | Ching |
| 2009/0011827 | A1 | 1/2009 | Englman |
| 2009/0023489 | A1 | 1/2009 | Toneguzzo |
| 2009/0023492 | A1 | 1/2009 | Erfanian |
| 2009/0061974 | A1 | 3/2009 | Lutnick et al. |
| 2009/0082093 | A1 | 3/2009 | Okada |
| 2009/0098934 | A1 | 4/2009 | Amour |
| 2009/0118006 | A1 | 5/2009 | Kelly et al. |
| 2009/0124344 | A1 | 5/2009 | Mitchell et al. |
| 2009/0131158 | A1 | 5/2009 | Brunet De Courssou |
| 2009/0131175 | A1 | 5/2009 | Kelly et al. |
| 2009/0143141 | A1 | 6/2009 | Wells |
| 2009/0149233 | A1 | 6/2009 | Strause et al. |
| 2009/0176560 | A1 | 7/2009 | Herrmann et al. |
| 2009/0176566 | A1 | 7/2009 | Kelly |
| 2009/0221355 | A1 | 9/2009 | Dunaevsky et al. |
| 2009/0247272 | A1 | 10/2009 | Abe |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0035674 | A1 | 2/2010 | Slomiany |
| 2010/0056247 | A1 | 3/2010 | Nicely |
| 2010/0062836 | A1 | 3/2010 | Young |
| 2010/0093420 | A1 | 4/2010 | Wright |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gergon |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0109454 | A1 | 5/2011 | Mcsheffrey |
| 2011/0111837 | A1 | 5/2011 | Gagner |
| 2011/0118011 | A1 | 5/2011 | Filipour et al. |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |

(56) References Cited

U.S. PATENT DOCUMENTS

| | | | |
|---|---|---|---|
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0202587 | A1 | 8/2012 | Allen |

FOREIGN PATENT DOCUMENTS

| | | | |
|---|---|---|---|
| JP | 2003111980 | A | 4/2003 |
| JP | 2003525718 | A | 9/2003 |
| JP | 2004097610 | | 4/2004 |
| JP | 2004097610 | A | 4/2004 |
| JP | 2004166746 | A | 6/2004 |
| JP | 2008510525 | A | 4/2008 |
| JP | 2008119469 | A | 5/2008 |
| JP | 2008522744 | A | 7/2008 |
| JP | 2009285189 | A | 12/2009 |
| JP | 2009544354 | A | 12/2009 |
| JP | 2010187857 | A | 9/2010 |
| JP | 2013521061 | A | 6/2013 |
| WO | 9851384 | A1 | 11/1998 |
| WO | 2010087090 | A1 | 8/2010 |
| WO | WO2011/109454 | | 9/2011 |
| WO | 2012139083 | A1 | 10/2012 |

OTHER PUBLICATIONS

International Preliminary Report on Patentability, PCT/US2011/063587, Jan. 7, 2013.

International Search Report and Written Opinion, PCT/US2011/063587, Apr. 16, 2012.

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

IP Australia, Patent Examination Report No. 1, Patent Application No. 2011338543, Jul. 24, 2013.

ITL.NIST.GOV, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

Japan Patent Office, First Office Action, Japan Patent Application No. 2013-541079, Nov. 5, 2013, Japan.

Japan Patent Office, Second Office Action, Japan Patent Application No. 2013-541079, 03 Jun. 2014, Japan X.

Fantasia Earth Zero, Famitsu Connect!on, vol. 30, Enterbrain K.K. 2009, May 11, p. 128 to 131. X.

Ip Australia, Patent Examination Report No. 2, Patent Application No. 2011338549, 06 Jun. 2014. X.

ENHANCED SLOT-MACHINE FOR CASINO APPLICATIONS

CROSS REFERENCE TO RELATED APPLICATIONS

The present application is a continuation of U.S. application Ser. No. 13/854,658, filed on Apr. 1, 2013, which is a continuation of PCT Application No. PCT/US11/63587 filed Dec. 6, 2011 which claims the priority of U.S. Provisional Application No. 61/459,131, filed Dec. 6, 2010, and U.S. Provisional Application No. 61/460,362, filed Dec. 31, 2010, the contents of each of which are incorporated by reference herein.

BACKGROUND

1. Field

This disclosure relates generally to a game of chance that provides players a rich (i.e. akin to leading home- and arcade-based video games) environment in which the participant(s) win cash and credits as a result of their play activity within the environment, based on the wagers which they make entering and playing the game, and more specifically to the methods and apparatus necessary to create and operate the hardware and software constituent components in the context of a game of chance environment.

2. Description of Related Art

The gaming machine manufacturing industry provides a variety of gaming machines for the amusement of gambling players. An exemplary gaming machine is a slot machine. A slot machine is an electro-mechanical game wherein a random number generator determines the outcome of a gambling game, and this, coupled with the betting decisions of a player, results in a specific payout. Slot machines are usually found in casinos or other more informal gaming establishments.

Games involving random outcomes for gambling games and games having a player skill component have been combined. For example, U.S. Patent Application Publication No. 2005/0239538 A1 discloses a gaming apparatus that includes a video game unit, a gambling game unit and a game interface unit. The game interface unit controls the playing of the video game unit based on the playing of the gambling game unit. The gaming apparatus is further configured to pay winnings to a player playing the gaming apparatus based on signals from the game interface unit.

U.S. Patent Application Publication No. 2008/0108425 A1 discloses a gaming device that enables players to play an interactive game and make wager components that occur during the interactive game, where the wagering outcome for each of the wager components is independent from the interactive game. The interactive game is a skill based game initiated by the player. The player funds the gaming machine and during play of the interactive game, upon the occurrence of a wager triggering event, the gaming machine causes a wagering event to occur. The wagering event includes a placement of a wager component and a random determination of a wagering outcome for that wagering event.

U.S. Patent Application Publication No. 2010/0056247 A1 discloses a gaming device that includes a game or game event having an element of strategic skill. The game or game event enables a player to make strategic choices or decisions that have a direct impact on the player's chance of obtaining one or more outcomes or awards in a play of a game.

U.S. Pat. No. 7,326,115 discloses a gaming machine having a first interactive game requiring one or more player inputs. The player inputs result in one or more outcomes. The outcomes do not result in a monetary or other valuable award provided to the player. Rather, a second wagering game is always provided to the player where the player can obtain or has a chance to obtain a monetary or other valuable award.

U.S. Patent Application Publication No. 2009/247272 discloses a gaming machine having a display which arranges a plurality of symbols in a matrix of arrangement areas. The gaming machine provides a base game and a plurality of feature games using the display by rearranging the plurality of symbols in the arrangement areas in the base game, awards a base payout in accordance with a relation among the symbols rearranged in the arrangement areas, awards a feature game which corresponds to the number of predetermined symbols rearranged in the arrangement areas, performs the feature game and awards a bonus payout in accordance with a result of the feature game.

U.S. Pat. No. 5,718,429 discloses a game in which people may place a stake in a casino game and win a cash prize in a skill game. Stakes in the casino game are placed with chips, which may be purchased in exchange for the services of conducting the casino game. A winning stake is rewarded with a token, rather than with money. A token may be exchanged for an opportunity to demonstrate a skill in the skill game. Those that successfully demonstrate the skill are awarded cash or other prize.

U.S. Pat. No. 5,785,592 discloses an interactive target game system for one or more players which may include a vehicle on which a player may ride over a predetermined pathway in a defined area (or the player may walk.) The game includes at least one designator, holdable by a player for aiming at a target and operating to simulate shooting at the target, and at least one target disposed in proximity to the pathway. An indicator device responds to the designator being accurately aimed at the target and operated, for producing an indication of a "hit" or score. The targets may include opportunities to play a game of chance.

U.S. Patent Application Publication No. 2004/0121839 discloses a gaming apparatus operable by a player to simulate a card game in which a hand of cards is dealt to the player. The gaming apparatus displays an image of a player hand including at least one obscured card when first dealt, and modifies the display image data in accordance with player instructions received by the input means, to cause the created image to reveal each obscured card in a manner determined by the player.

U.S. Patent Application Publication No. US2011/0207523 discloses a gaming system includes a plurality of gaming devices and a controller configured to communicate with the gaming devices. The gaming system enables a plurality of players to play an interactive game in a non-competitive mode and in a competitive mode. If at least two players play the interactive game in the competitive mode, for a competitive wagering event, which includes a competition between two players, the gaming system determines a winning player and a losing player.

U.S. Patent Application Publication No. 2011/0118011 discloses a gaming system that determines whether to provide at least one of a plurality of progressive awards to a player based on that players measured level of skill in: (i) a plurality of plays of a partial skill-based game, (ii) a skill-based progressive award sequence, or (iii) a plurality of plays of a partial skill-based game and a skill-based progressive award sequence. The determination is based on zero, one or more inputs made by the player which tend to measure that player's level of skill in at least one of a partial skill-based game and a skill-based progressive award sequence.

U.S. Patent Application Publication No. 2010/0016056 discloses a gaming system providing passive participation in at least one wagering game. Funds are received to obtain a period of eligibility for an award associated with the wagering game. An entertainment layer having a plurality of features is conducted in response to receiving the wager. A separate gaming layer includes the wagering game. A gaming machine having a display and a player input device is in communication with the entertainment layer and the gaming layer. At least one feature of the entertainment layer is conducted during the period of eligibility. The entertainment layer is operable in response to at least one input from the player input device. Information regarding the wagering game is presented on the gaming machine.

U.S. Patent Application Publication No. 2008/0274798 disclose a system wherein an event experienced by a player is documented and the documentation of the event is stored (e.g., in association with an indication of the event). One example of an event experienced by a player is an outcome obtained by a player on a gaming device. In such an embodiment the documentation of the event may comprise an image of the players reaction to the outcome and/or a still or video image of the outcome. In accordance with some embodiments of the present invention a player may subsequently access (e.g., purchase) an output of the documentation. Meta-data may be used to locate a particular documentation. In one embodiment an outcome of a prior game play that was documented is replayed. Documentation of events may be modified by a player.

U.S. Patent Application Publication No. 2006/0003830 discloses a method of operating a gaming device. The method includes the steps of (i) receiving audio/video content; (ii) associating a plurality of sets of outcome values with the audio/video content; (iii) determining a play session; (iv) determining which of the plurality of sets of outcome values to associate with the audio/video content for a duration of the play session, thereby determining an active set of outcome values; (v) determining a result of a game play during the session; (vi) selecting, based on the result, a value from the active set of outcome values; and (vii) outputting, as an indication of the result, the audio/video content and an indication of the selected value.

SUMMARY

In the present disclosure, a gaming or slot machine is provided for use in a physical or virtual casino environment, which provides players an environment in which to play for cash against the casino in a regulated manner, with an entertainment interface adapted from video entertainment games which are popular today (such as those executing on a PlayStation®, Wii® or Xbox®) and/or that were popular in the past (e.g. titles such as Asteroids™, Space Invaders™, Defender™, etc. that operated as stand-alone arcade games and/or on consoles such as ColecoVision™, IntelliVision™, etc.)

In one aspect, an enticing method of gaming is provided to players who expect a high level of entertainment content in their gaming experience compared to the relatively simple game methods in use today. The method provides for a random result independent of player skill while ensuring that the resulting result is displayed to the player in much more entertaining manner than conventional slot machines.

In another aspect, these games are installed and connected by a network on a casino floor, and/or be connected by various means to a wide area network to a server conglomeration that controls various aspects of the gaming environment, provides gaming regulatory body monitoring, provides financial accounting and provides forms of frequent player monitoring for marketing purposes.

In another aspect, such a system is implemented whereby the aforementioned wide area network is inclusive of the Internet.

In one embodiment, a gaming system receives a request for a wager for a player of an entertainment game, the request being triggered by a player action taken by the player while playing the entertainment game. The gaming system establishes a result for the wager and generates, based on the result of the wager, a controlled sequence of a portion of the entertainment game, the controlled sequence changing the state of the entertainment game as the entertainment game is being played by the player.

In another embodiment, the controlled sequence portion of the entertainment game is generated further on the basis of the player's actions in playing the entertainment game.

In another embodiment, the controlled sequence portion of the entertainment game is a beginning portion, intermediate portion or outcome portion of the entertainment game.

In another embodiment, the result of the wager is displayed to the player of the entertainment game separately of the entertainment game.

In another embodiment, the controlled sequence portion of the entertainment game is further based on an action of a third party.

In another embodiment, the gaming system receives one or more additional wagers from one or more additional players playing the entertainment game. The gaming system then establishes one or more additional results for the one or more additional wagers, and the gaming system generates the controlled sequence portion of the entertainment game based on the results of the wager and the one or more additional wagers.

In another embodiment, the wager is included in a wagering queue with other wagers, the gaming system establishes a result for each wager in the wagering queue, and the gaming system generates the controlled sequence portion of the entertainment game using the results of the wagers in the wagering queue.

In another embodiment, generation of the controlled sequence portion of the entertainment game further includes a conditioning function to relate the result of at least one wager in the wagering queue with the controlled sequence portion of the entertainment game.

In another embodiment, the generation of the controlled sequence portion of the entertainment game further includes using the conditioning function to relate the result of the general direction of win or loss of the wagers in the wagering queue with the controlled sequence portion of the entertainment game, wherein the result of the controlled sequence portion of the game may be decoupled on a wager by wager basis, while still being coupled on a summation basis as summed over the wagers.

In another embodiment, the type of wager is based on a choice made by the player in playing the entertainment game In another embodiment, the amount of the wager is based on a choice made by the player in playing the entertainment game.

In another embodiment, the odds of the wager are based on a choice made by the player in playing the entertainment game.

In another embodiment, the request for the wager is in response to the player consuming a first type of Enabling Element (EE) in the entertainment game, and wherein the player is awarded a second type of EE different from the first type of EE, based on the result of the wager.

In another embodiment, the different type of EE affects the controlled sequence of the portion of the entertainment game.

In another embodiment, the different type of EE affects the result of a subsequent wager.

In another embodiment, the different type of EE affects the result of a subsequent wager and affects the controlled sequence of the portion of the entertainment game.

This brief summary has been provided so that the nature of the disclosure may be understood quickly. A more complete understanding can be obtained by reference to the following detailed description and to the attached drawings.

DETAILED DESCRIPTION

Figure 1:
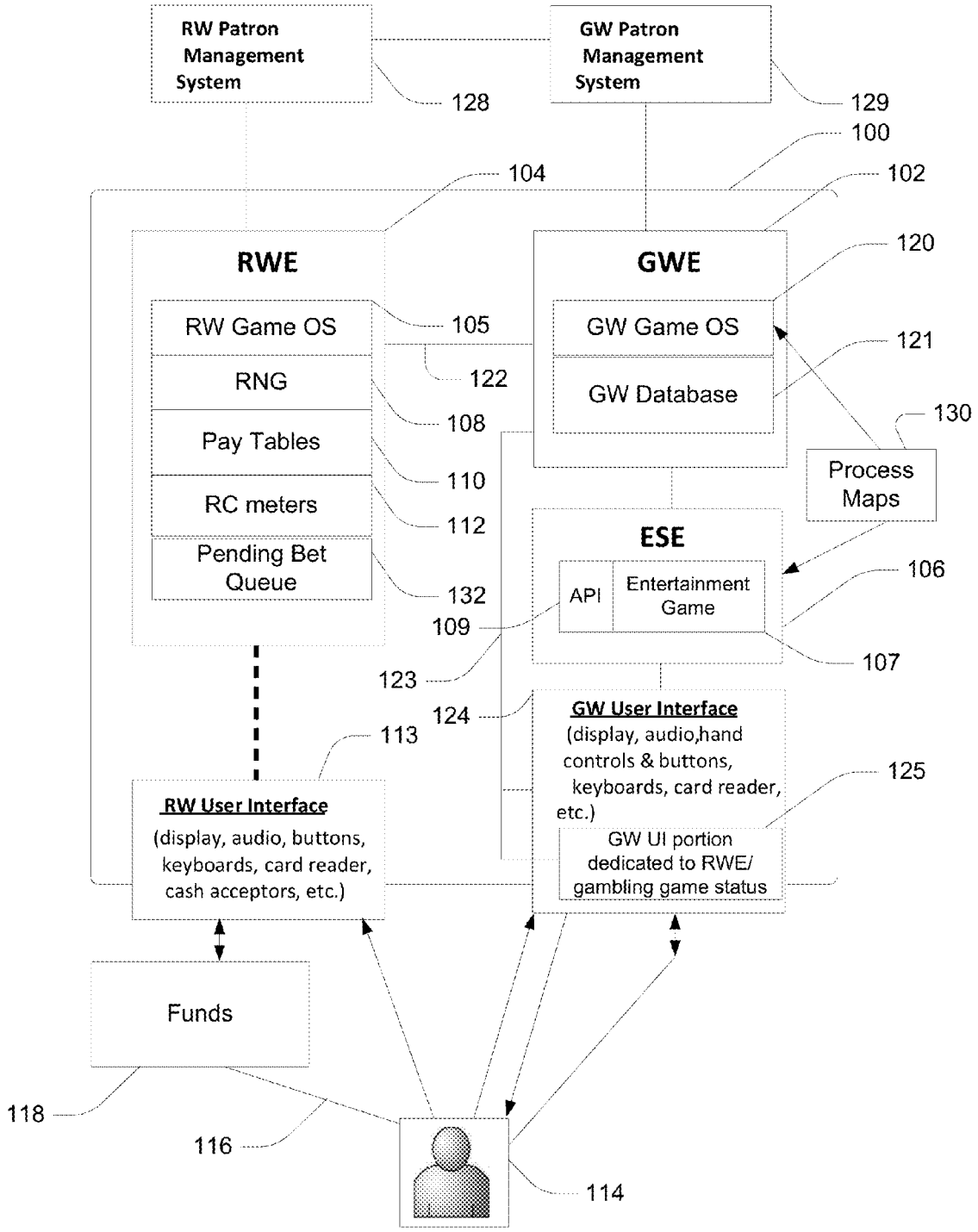
FIG. 1 is a diagram illustrating exemplary architecture of a gaming system and the interaction between three primary systems of a GWE, an RWE and an ESE.

FIG. 1 is a diagram illustrating exemplary architecture of a gaming system 100 and the interaction between three primary systems of a GWE 102, an RWE 104 and an ESE 106. A hybrid game is a gaming system featuring a combined RWE, GWE and ESE game as described herein.

In numerous embodiments, the RWE 104 is the operating system for a real world (RW) portion of a hybrid game that concerns itself with real random gambling events, money credits on the hybrid game, and other parameters associated with execution of a gambling game. The RWE manages the RW portion of the gaming system and controls and operates a gambling proposition. The RWE 104 includes the random number generator RNG 108, pay tables 110, meters 112 and other hardware and software constructs used by the game of chance to offer a fair and transparent gaming proposition, and to contain the auditable systems and functions necessary for the game to obtain gaming regulatory body approval. The RNG may be a software and/or hardware device which is used to generate random outcomes. In some embodiments, a random number may be received via a network connection.

The RWE 104 encompasses the components of a slot machine but may not necessarily include an entertainment front end. The RWE 104 accepts triggers from the RW User Interface 113 to run gambling propositions in response to actions taken by the player 114 in the context of the ESE 106 driven entertainment game controlled sequence and also provides information to the GWE 102 to expose the player to certain aspects of the gaming proposition, such as odds, amount of credits in play, amount of credits available, etc.

In some embodiments, an RWE manages the RW portion of the game and contains the mechanical, electronic and/or software devices to: (a) provide control of the RW portion of the game, (b) communicate metrics of wagering to the GWE, (c) contain various audit logs and activity meters, (d) couple to a centralized server for exchanging various data related to accounting of the gambling proposition, the player and their wagering activities on the game along with other functions.

In numerous embodiments, the GWE is a portion of a hybrid game gaming system which includes the electronic and software device to perform one or more of the following, but not limited to: (a) couple to the RWE to receive the results of real-world wagering and other parameters related to the state of the gambling activity in general, (b) directly display to the user through a GWE user interface the results of real-world wagering and other parameters related to the state of the gambling activity in general, (c) couple to the ESE to direct the ESE to provide appropriate output to the player in response to the results of RW wagering and the state of the gambling activity in general, (d) operate in conjunction with the ESE to receive gambling game input parameters from the player in the context of the ESE driven audio-visual display, (e) couple to the RWE to communicate gambling game input parameters to the RWE, and (f) communicate with a patron management system for management of player information.

In many embodiments, the GWE 102 and ESE manage a game world "GW" which is a video game or entertainment game portion of the gaming system that includes information typically associated with this virtual entertainment environment including its game characters or objects, character action, game scores.

FIG. 1 also illustrates the GW operating system. The GWE's 102 function is to interface between the RWE 104 and the ESE 106. The ESE 106 hosts an entertainment game 107 that supplies the logic for operation of an entertainment game by a player. The ESE 106 uses protocols for operation of the entertainment game such as those exposed by the entertainment game's 107 Application Programming Interfaces (APIs) 109 for setting up the entertainment game's 107 interfaces, testing of the entertainment game 107, making user settings for the entertainment game 107 and determining the status of the entertainment game 107.

It is noted that in the case of the RWE 104 in this arrangement, through explicit player choices, operation of the GWE 102 may affect selection of the RWE's 104 bet or wager size, pay tables, bonus round selections, and/or other configuration variables, In the case of all such choices, the profile of the RWE 104 controlled gambling game is directed by the player 114, either directly or indirectly through the GWE 102.

The communication link 122 shown between the GWE 102 and the RWE 104 in FIG. 1 has at least two purposes. The first being that it allows the GWE 102 to obtain information from the RWE 104 as to the amount of credits available on the RW portion of the game, the result of each gambling proposition, and necessary status operation of the RWE 104 (such as on-line or tilt). The communications link 122 also provides a means by which the GWE 102 communicates to the RWE 104 parameters that serve as inputs to the RWE 104 controlled gambling game (e.g. credits to be bet or wagered, electing to participate in bonus rounds, etc.).

The GW game operating system has at least three activities. The first is to take the results of each RWE 104 controlled gambling game undertaken in the RWE 104, and to direct the ESE 106 to output a specific type of audio-video event as a result. The GW Game OS 120 accesses a GW database 121 that in accord with processes in the GW Game OS 120 translates each possible result of the RW gambling game into a command or commands to the ESE 106 to generate a controlled sequence of a portion of an entertainment game of the ESE 106 resulting in an entertainment game state or states that are output as an audio-video event to the player. This particular function is defined by one or more Process Maps 130, which may be entirely or partially resident within the GW Game OS 120.

In another aspect, the GW game operating system sets flags or variables that the ESE 106 uses to condition ESE 106's own process of generating a controlled sequence of a portion of the entertainment game as an audio-video event. That is, the specific audio-video event need not be dictated by the GWE 102.

The GWE 102 also may display, directly to the user through display, audio, meters and/or other means the details regarding the player's 114 current state in regard to the RWE 104 controlled gambling game. Specifically, the number of credits in the RWE 104 controlled gambling game, the current status with regard to bonusing, the current setting as relates to the number of credits to be bet or wagered, etc. are examples of, but not a limit to, the information that can be presented to the player 114 at all times through the GWE's 102 access of the portion of the GW User Interface dedicated to display of the RW activity, GW User Interface 125.

In another aspect, the GWE 102 displays this information in coordination with the ESE 106 so that the presentation of such information appears to seamlessly integrate with the entertainment content generated by the ESE 106 and displayed on the GW User Interface 124. An example of this might be displaying the gambling or wagering results of the player 114 on the scoreboard in a football game. Another example is to show the explosion and subsequent implosion of a building under attack in a military game based on a favorable RW gambling or wagering result.

In another aspect, the RWE 104 may be the entity that displays the details regarding the player's current status with regard to the RWE 104 controlled gambling game by signaling sent to the GW User Interface 125, or may directly interface with the ESE 102 to provide this information to the player 114. Selection of whether the GWE 102 or the RWE 104 assumes responsibility for display of gambling status would typically be driven by gaming regulatory requirements.

The GWE 102 also conveys player choices to the RWE 104 that affect the RWE 104 controlled gambling game inputs, as made by the player in the context of the ESE 106 driven entertainment game audio-visual display.

In FIG. 1, the GWE 102 also connects to the ESE 106. The ESE 106 manages and controls the visual, audio and player entertainment for the game. The ESE 106 accepts input from the GWE 102 as to the type of audio-video event that is to be presented to the user, acts upon this input while reflecting the current state of the audio-visual game and updates the audio visual display accordingly with the aim of providing an engaging entertainment game controlled sequence to the player. This cycle of the GWE 102 of collecting information from the RWE, conditioning it, passing information to the ESE 106, and the ESE 106 acting upon it (after possibly having conditioned it further), may transpire with each play of the RW game.

In many embodiments, the ESE includes the electrical and software systems that provide a rich multi-media output of high entertainment value to the player in response to the RW gambling or wagering result and state. A PC, a handheld tablet, Sony PlayStation®, Wii® or Microsoft Xbox® running a modified version of a specific game program (e.g. Madden Football '10) are some embodiments of hosts for an ESE. In some embodiments, the ESE exchanges data with and accepts control information from the GWE. One purpose of the ESE's interaction with the GWE is to (1) to ultimately translate RW game play into a controlled sequence of an entertainment game to provide a higher level of entertainment value to the player (2) to provide an audio-visual display which serves as the context in which the player selects the inputs to the RWE 104 controlled gambling game (e.g. number of credits to be bet or wagered), (3) to interact with the GWE to provide a means by which input parameters for RW game play can be collected from the player. At the direction of the GWE, which in turn receives input from the RWE (representing the state of RW game play), the ESE drives an audio-visual display that closely approximates the experience of playing a video game or an arcade game. controlled sequence "Process Map". An combination of a series of rules, logic, databases and processes which may be static or formulaic, deterministic and/or include an element of randomness, that dictates, in whole or in part (i.e. the output from the Process Map may be further conditioned independently by GWE or ESE-resident software) the way in which a gambling or wagering result achieved in the RWE is represented to the player by the ESE software in the GW context. The Process Map may reside in the GWE, the ESE or both.

The ESE 106 enables a wide range of game themes including popular titles from arcade and home video games (e.g. Gears of War™, Time Crisis™, Madden Football™, etc.). The ESE 106 can also be dedicated to a single game theme to provide the seamless and sensible operation of the gaming system as a richer experience than conventional slot machines.

In other aspects, the ESE 106 may also signal the GWE 102 as to player actions in the GW context, and other GW parameters (type of character, car, weapon, etc.) for the GWE's 102 use in triggering gambling plays or wagers and configuring the overall profile of the RWE 104. According to these aspects, a cycle of the gaming system includes the player making choices and taking actions within the GW context thereby signaling the ESE 106 through the GW User Interface 124. The ESE 106 in turn signals the GWE 102 of these choices and actions, and the GWE configures wagers and other factors of the RWE 104 for RW wagers that create a wagering or gambling result as gambling plays transpiring with the player's interaction with the ESE 106 (via the GW User Interface 124).

In another aspect, the RWE is coupled to a RW patron management system 128 for the purposes of player management and game accounting for a gambling game such as real world credit (RC) accounting and tracking. Additionally, the RW patron management system may also track game world credit, entertainment game player profiles and configurations, etc. for the purposes of an entertainment game played by a player. RC are entered into the hybrid game by the player, casino operator or third party, either in the form of currency, tickets or other medium as issued by the operator of the game (e.g. a casino). RC may be of a nature that they are convertible back into currency by a player, casino operator or third party.

In another aspect, the GWE may be coupled to a GW patron management system 129 for the purposes of tracking game world credit, managing entertainment game player profiles and configurations, etc. for the purposes of an entertainment game played by a player.

In another aspect, the RW patron management system and the GW patron management system may be linked together.

In another aspect, the RW patron management system and GW patron management system may be part of a single patron management system.

In another aspect, two or more RWEs may be coupled to two or more GWEs. This allows two or more players to use play an entertainment game of the gaming system either competitively or cooperatively while each of the two or more players has their own RWE to manage each player's wagers and results independently. By use of such a feature, each player can have their own unique gambling or wagering result sequence.

The architecture of a gaming system as shown in FIG. 1 may be physically accomplished as shown literally, or may be more virtual in nature. For example, a single or a plurality of controllers may divide up the logical tasks reflected, the user interfaces shown could be combined to a single or plurality of display screens, player feedback and controls, that connections shown to the RW patron server 128 for the purposes of game accounting, RC and game world credit tracking and other functions could be a single connection to a single server, a single connection to a plurality of servers, multiple connections to multiple servers, etc., such that the system could be accomplished in a highly virtualized space, such that the RWE 104 and GWE 102 were large scale centralized servers "in the cloud" coupled to a plurality of widely distributed ESE controllers, such as ESE 106, or clients via the Internet.

In many embodiments, a hybrid game is deployed in a gaming establishment, such as a casino, in either one or a plurality of locations where people go to play gambling games of chance. A casino, for the purposes of this document, may also refer to a virtual manifestation of a casino, such as an on-line casino or other gambling operation. Casinos are typically operated by a person or an entity that may operate one or more gambling operations, including but not limited to a Wide Area Network gaming franchise, a gaming route, or other gambling business be it a physical manifestation in the case of a casino or virtual in the case of an internet gambling operation.

In some embodiments, an entertainment game of a hybrid game is a game that is provided to a player that the player interactively plays. Examples of entertainment games are video games or the like. In various aspects, an entertainment game can include elements of skill play, partial skill play or pseudo-skill play. In addition, an entertainment game may include multiplayer aspects where two or more players can play either competitively or cooperatively.

In numerous embodiments, the GWE and ESE operate to manage game world credit (GWC). GWC is credit earned or depleted as a function of player skill, i.e. as a function of player performance in the context of the game. According to various embodiments of GWC, entertainment games of different types may have different scoring criterion, may have different GWC types, and different GWC magnitudes. GWC may be perpetual and may be carried forward from one level of game play to another and from one gaming session to another. GWC may ultimately be paid out in various manners such as directly in cash, or indirectly such as earning entrance into a sweepstakes drawing, or earning participation in, or victory in, a tournament with prizes. GWC may be stored on a player tracking card or in a network-based player tracking system and the GWC is attributed to a specific player. In addition, GWC may span more than one type of game and not only may GWC be carried forward from one level of game play to another but from one game to another.

Figure 2:
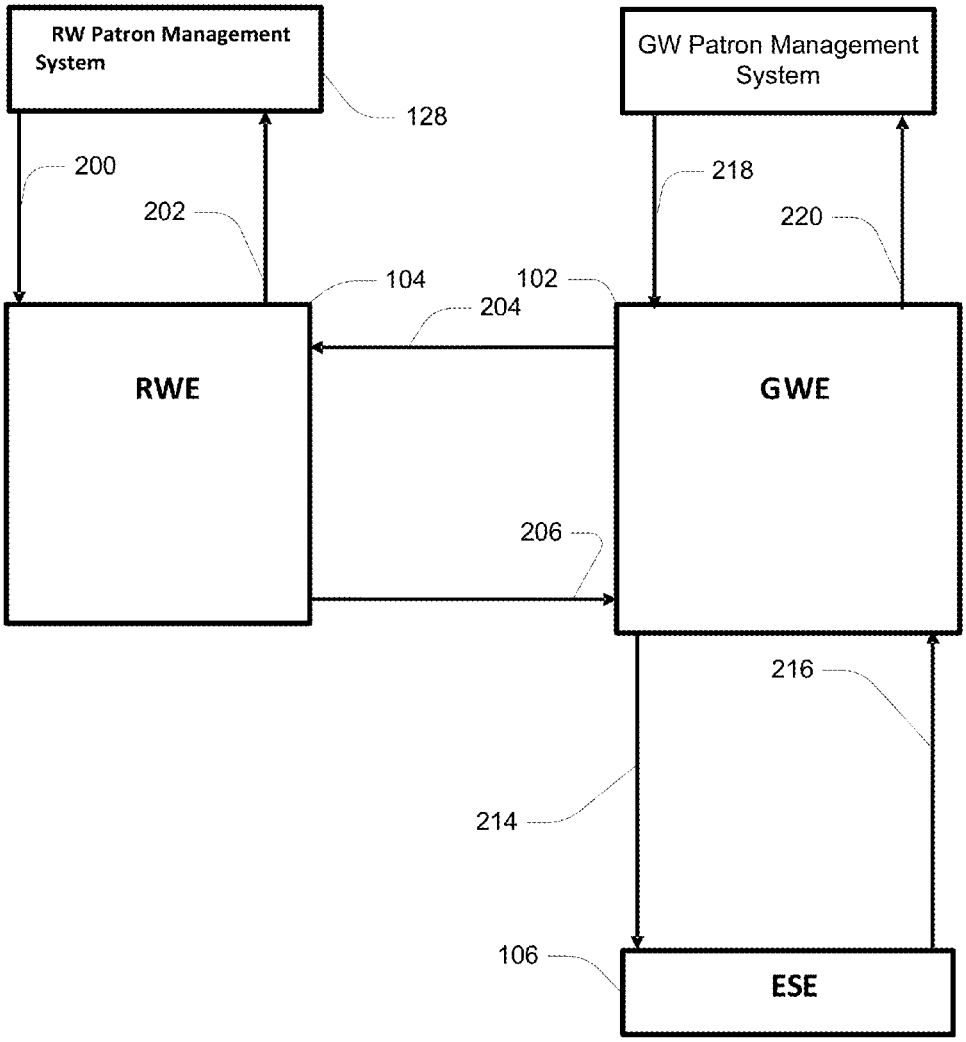
FIG. 2 is a data flow diagram illustrating exemplary data flow between a RW Patron management system, an RWE, a GWE and an ESE.

FIG. 2 is a data flow diagram illustrating exemplary data flow between an RW patron management 128, a GW management system 129, an RWE 104, a GWE 102 and an ESE 106. The examples of communications flow in FIG. 2 are not intended to be exhaustive or all inclusive, but rather serve as practical examples of the kinds of data exchanged over the illustrated interfaces.

The RWE 104 may be connected to a RW patron management system 128. The RW patron management system sends parameters 200 to the RWE, such as Ln-RC tables, max speed of play, game monetary denomination and casino promotion RC. The RWE 104 sends parameters 202 to the RW patron management system 128, such as the RC in a current game, RC wagered in the current play session, RW player account information, player activity, player profiles, etc.

The RWE 104 is further connected to the GWE 102 and receives player choices and actions that may be used as gambling or wagering triggers 204 for a RWE 104 controlled gambling game.

The RWE 104 transmits parameters and objects 206 to the GWE 102, such as status of the RWE, a gambling or wagering play results, Ln-RC table information, RW patron management system data, whether or not it is possible to enter a bonus round, the game monetary denomination and other RWE parameters.

Ln-RC tables are tables which dictate the real credit earned as a function of game play and is analogous to the pay tables used in a conventional slot machine. TABLE Ln-RC payouts are independent of player skill, and the output of the table is established by applying a random number generator against a table of potential outcomes. There may be one or a plurality of TABLE Ln-RC pay tables contained in a game design, the selection of which being determined by game progress a player has earned, and bonus rounds which a player may be eligible for.

The GWE 102 also transmits parameters and objects to the RWE 104, such as the RC used to play per RWE game, whether to enter or decline a bonus round, casino promotional RC and audit information. The audit information includes a game title, profile and status, Ln-GWC table information, GWC points and audit information, game software and firmware versions and signatures, and player and profile information.

The GWE 102 is also connected to the ESE 106 and transmits parameters and objects 214 such as ESE 106 controlled entertainment game software, difficulty settings, game score enhancements, cheats, character profiles and setups, equipment inventory, random complexity modifications, changes in the GW character's status in the game.

The GWE 102 receives from the ESE 106 parameters 216 such as player choices and actions (choice is to open a treasure chest, action is to use magic wand to open the treasure chest) chosen through a UI, GW character profiles, GW equipment and inventory, game scores, random complexity ratings, language selection and tournament and multiplayer information.

The GWE 102 may also be connected to a GW patron management system 129. The GW patron management system sends parameters 218 to the GWE, player entertainment game configurations, a player's current GWC accumulation, etc. The GWE 102 sends parameters 220 to the GW patron management system 129, such as the GWC in a current entertainment game, GWC that the player is using to acquire access to various elements within the entertainment game, GW player account information and player activity and profiles.

The architecture of a gaming system as shown in FIG. 2 may be physically accomplished as shown literally, or may be more virtual in nature. For example, a single or a plurality of controllers, hosts or servers may divide up the logical tasks reflected, the user interfaces shown could be combined to a single or plurality of display screens, player feedback and controls, that connections shown to the RW patron server 128 and for the purposes of game accounting, RC tracking and other functions could be a single connection to a single server, a single connection to a plurality of servers, multiple connections to multiple servers, etc., such that the system could be accomplished in a highly virtualized space, such that the RWE 104 and GWE 120 were large scale centralized servers "in the cloud" coupled to a plurality of widely distributed ESE controllers, such as ESE 106, or clients via the Internet.

Figure 3A:
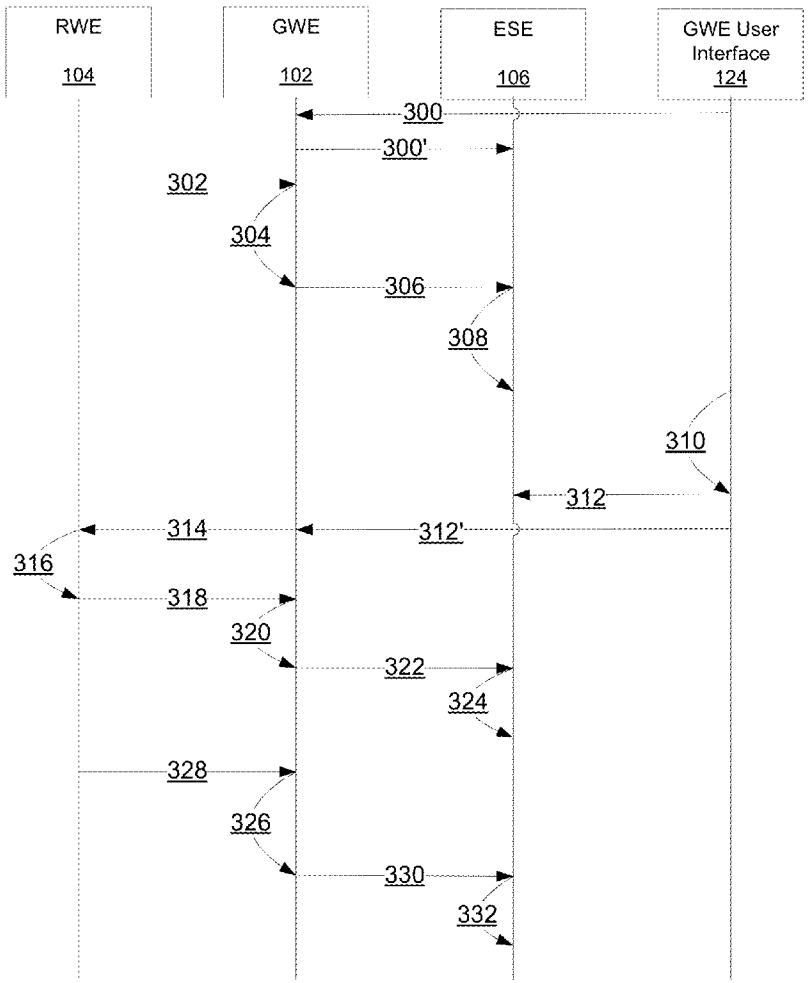
FIG. 3*a* is a sequence diagram illustrating sequencing of exemplary data flows between an RW Patron Management System, an RWE, a GWE and an ESE.

FIG. 3*a* is a sequence diagram illustrating exemplary data flows between the RWE 104, the GWE 102 and the ESE 106 of FIGS. 1 and 2. The examples of communications flow are not intended to be exhaustive or all inclusive, but rather serve as practical examples of the kinds of data exchanged over the interfaces.

Selecting Player Preferences

In one aspect, at the onset of a game session, the ESE 106 receives information 300 and 300' about player preferences through the GW User Interface 124 via the GWE 102 as a means of selecting the entertainment theme for an entertainment game controlled sequence, or to make specific selections as relates the characters or teams or other variables active in the context of the entertainment theme. For example, the gaming system 100 (of FIG. 1) may be set up such that the ESE 106 houses software related to video football (e.g. Madden Football™), video hockey (e.g. NHL2K10™) and/or a video soccer game (e.g. 2010 FIFA World Cup™). The player 114 (of FIG. 1) might decide they want to gamble at the gaming system in the context of football and could input this information through a touch screen that is part of the GW User Interface 124. The resulting information is used to configure the ESE 106 and/or the GWE 102.

Once the player 114 (of FIG. 1) has selected football they could, in one implementation, further select the team they want to be (e.g. New Orleans Saints™), and the team they wish to oppose. Again, this information could be, for example, entered through a user input device such as a touch screen. In another implementation, the player 114 (of FIG. 1) can make more detailed selections to characterize the operation of the ESE 106. For example, the player 114 (of FIG. 1) could select individual football players for their team.

User preferences and status in the RWE 104, and all other information presented to the user in a conventional slot machine (e.g. number of credits, number of credits currently being bet or wagered per game play, etc.), in addition to gambling or wagering results, may also be represented within an entertainment game controlled sequence managed by the ESE 106. In each case, the information of interest 302 is communicated from the RWE 104 to the GWE 102 (either at the request of the GWE 102, or on a push-basis from the RWE 104). The GWE 102 then translates (304) this information into the command, data or signaling (or plurality thereof) 306 necessary to cause the ESE 106 to generate (308) a controlled sequence of a desired portion of an audio-visual display as a part of the ESE's 106 entertainment game controlled sequence.

Triggering Bets or Wagers by Player Actions or Choices

In another aspect, once configured the player 114 (of FIG. 1) commences gambling by taking actions and making choices in the context of the ESE 106 entertainment game controlled sequence. The choices may be used to shape the type of bet or wager such as by altering the number of credits to be bet or wagered or the odds for the bet or wager. For example, the type of football play chosen in a video football implementation may dictate the number of credits to be bet or wagered and/or the football play dictates the shape of the bet more generally, such as a Hail Mary pass versus an up the middle run could invoke bets or wagers with different odds. The actions taken and choices made by the player forms part of the information 312 and 312', collected (310) via the GWE User Interface 124 in the context of an audio-visual user interface provided by the ESE 106, is relayed by the GWE 102 to the RWE 104 and is conveyed simultaneously to the player 114 (of FIG. 1) through the GWE User Interface 124 and/or the ESE 106 generated audio-visual display. The RWE 104 uses the information 312' to determine one or more bets or wagers for the player and establishes (316) for each bet or wager, via the RNG 108 (of FIG. 1) and pay tables 110 (of FIG. 1), one or more resulting outcomes for the one or more bets or wagers, as a gambling or wagering result that may have one or more results corresponding to the one or more bets or wagers. The gambling or wagering result 318 is fed back to the GWE 102. The GWE 102 may or may not directly display (320) the gambling or wagering result through the GW User Interface 125, and/or indirectly using the GW User Interface 124 in the game context.

In numerous embodiments, "EE" Enabling Element. The consumable and replenishable elements in an entertainment game that enable a player to play the entertainment game while consuming the element. Examples include, but are not limited to bullets, fuel, health points, potions, etc. to be used when playing an entertainment game.

The GWE 102 further directs (322) the ESE 106 to generate (324) a controlled sequence of a portion of the entertainment game reflective of the gambling or wagering result. The controlled sequence of a portion of the entertainment game changes the state of the entertainment game as well as defines how the entertainment game state will be displayed audibly and visually to the player. This may include transitioning through one or more entertainment game states and generation of one or more corresponding audio-visual displays for the player. In addition, the controlled sequence of a portion of the entertainment game may provide for additional player inputs that may form the basis for partially or wholly generating a portion of the controlled sequence or entertainment game states. For example, if five credits were bet or wagered based on the user selecting a mid-range passing play, and the RWE 104 controlled gambling game returned twelve credits as part of the gambling or wagering result, the GWE 102 may direct the ESE 106 to generate a controlled sequence of a portion of the entertainment game as a display of a play generating forward movement of the ball of 25 yards in favor of the team that the player 114 chose to represent them in the game. Additionally, the GWE 102 may dictate the specific play by which this forward movement of the ball was to be achieved, and in another aspect the ESE 106 would determine the type of play to be displayed, using logic internal to ESE's 106 software. In addition, as the controlled sequence of a portion of the entertainment game may be influenced by additional player inputs, the player may take an action, such as attempting to catch a pass as a direct player in the example football based entertainment game, the result of which may ultimately determine the remainder of a portion of the controlled sequence of a portion of the entertainment game or the state of the entertainment game.

The controlled sequence could be for any portion of the entertainment game. For example, he controlled sequence could establish the beginning portion of the entertainment game where the theme of the entertainment game is laid out for the player. The controlled sequence portion of the entertainment game could also be for an intermediate portion of the entertainment game, such as a major branching of the game play where the player is presented with either a more challenging portion of the entertainment game or a less challenging portion based on the gambling or wagering results. The controlled sequence portion of the entertainment game could also establish a final outcome portion of the entertainment game, such as the player ultimately being victorious or defeated.

If the player 114 (of FIG. 1) subsequently gambled another five credits and the gambling or wager result was such that these five credits were lost, a loss of yards on the play might transpire. Alternatively, other controlled sequences of a portion of the entertainment game might be made available, such as the resulting ESE 106 display might be signaled to show an incomplete pass, a short gain insufficient to achieve a first down, or even an interception. If this play was undertaken on fourth down, a fumble might ensue and possession would go to the other team. Once the ball was held by the other team, subsequent gambling propositions would cause display actions in the context of the player's team being on defense.

Process Map Use

In another aspect, the interaction between the GWE 102 and the ESE 106, by which the wager result drives ESE 106 generated audio-video output, is accomplished by virtue of one or more Process Maps 130 (of FIG. 1) whose purpose is to transform (332) gambling or wagering results into a set of directions that enable the ESE 106 to generate the appropriate portion of the audio-visual output in the ESE 106 driven entertainment game controlled sequence.

When the one or more Process Maps 130 (of FIG. 1) are resident entirely within the ESE 106, the GWE 102 may still operate between the RWE 104 and the ESE 106 and translate (326) the result 328 of the RWE 104 controlled gambling game output in the RWE 104 into a form that the ESE 106 can accept as input 330 to the one or more Process Maps 130 (of FIG. 1).

Bonusing, special events and other results of the RWE 104 controlled gambling game would be similarly mapped to events within the ESE 106, either explicitly via the GWE 102, or more generally by the GWE 102 along with the ESE 106 using the ESE's 106 own software (i.e. the one or more Process Maps 130 (of FIG. 1)) to convert the input from the GWE 102 into a specific controlled sequence of events within a portion of the entertainment game.

In another aspect, the controlled sequence portion of the entertainment game is only partially based on a gambling or wagering result. For example, the controlled sequence portion of the entertainment game could be also partially based on actions taken by the player, such as sequence of player or user inputs. As another example, the controlled sequence portion of the entertainment game may be partially based on an action of an operator of the gaming system, such as the operator of a gambling establishment providing a special bonus or complimentary award to a player. As another example, the controlled sequence portion of the entertainment game is further based on an action of a third party, such as another player playing competitively or cooperatively with the player of the entertainment game.

Figure 3B:
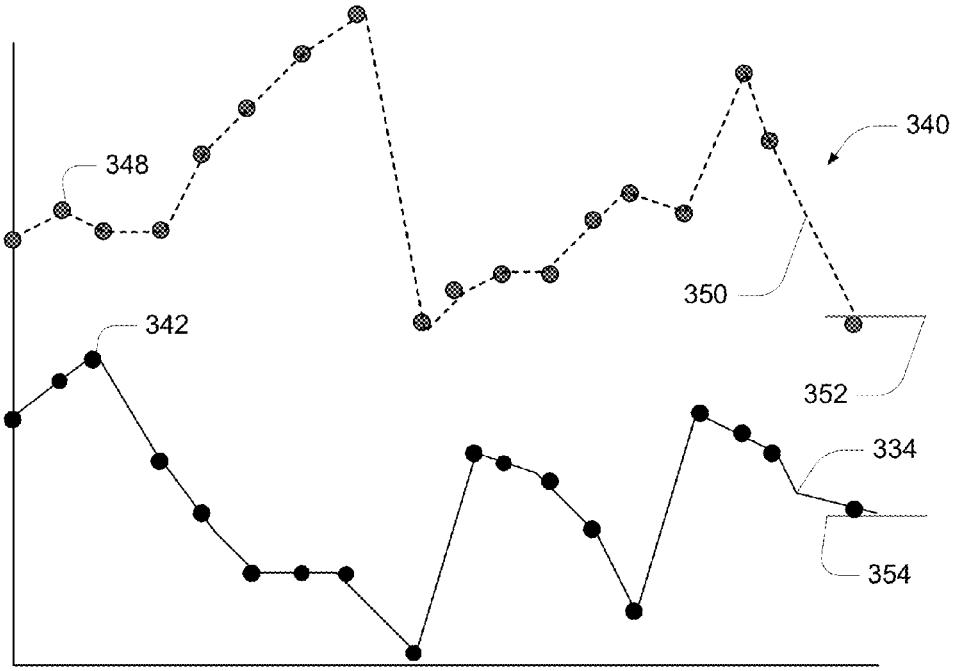
FIG. 3*b* is a graph illustrating an exemplary relationship between a series of wagering outcomes and a series of controlled sequences for portions of an entertainment game.

In another aspect, an entertainment conditioning function is used to transform a series of gambling or wagering results into a series of results that are more appropriate for generating a controlled sequence of a portion of an entertainment game in order to maintain a player's interest in what may be a losing series of gambling or wagering results. For example, FIG. 3*b* illustrates an exemplary series of gambling or wagering results corresponding to a series of results that can be used to generate a controlled sequence for a portion of an entertainment game. In the example, the entertainment game is related to a football game, but it should be understood that an entertainment conditioning function may be applied to any type of entertainment game. On graph 340 dots, such as dot 342, and respective curve 344, illustrate an RC credit meter on a gambling game for a series of gambling or wagering results. From graph 340, it can be seen that the player has some losses (as indicated by a fall in the RC credit meter) and wins (indicated by a rise in the RC credit meter). Also on graph 340, other dots, such as dot 348, and respective curve 350, represent a yardage meter for use in generating a display for an entertainment game. If the yardage advanced and lost in the football game were directly linked to RWE gambling or wagering results, a potentially unsatisfying script might emerge whereby the player, for a number of possessions, continues to lose yardage on every play regardless of how well the play calling was done.

As can be seen from graph 340, yardage is managed independently of the play by play result as indicated by the RWE gambling or wagering results. That is, there is not a one to one correspondence between the yardage gained or lost and the RC credits won or lost. This is accomplished through the use of an entertainment conditioning function, by use of its processes, and by looking forward at a Win/Loss Queue (WLQ) of the series of gambling or wagering results. By generating the yardage using an entertainment conditioning function, the entertainment game states reflected to the player as playing field results are managed so that over a play session, the final game entertainment game state 352 will generally be in line with the gambling or wagering result 354. This is to say, if the player finished their gambling play session a winner, then the player's team would be reflected to have dominated the other team in the scrimmage. If, however, the player lost a marginal amount of money in the session, the game could have played out to be close, with the player perhaps winning by a small margin late in the game, with the outcome of the entertainment game hanging in the balance to the last moment, and an unfortunate turnover in the last 45 seconds leads to the opponents long yardage field goal to win the game by 1 point. If the player sustained larger losses, the game could still be kept exciting throughout, so the result was not obvious to the player, but the opponent could overwhelm the player's team in the last 5 minutes of the game.

Figure 3C:
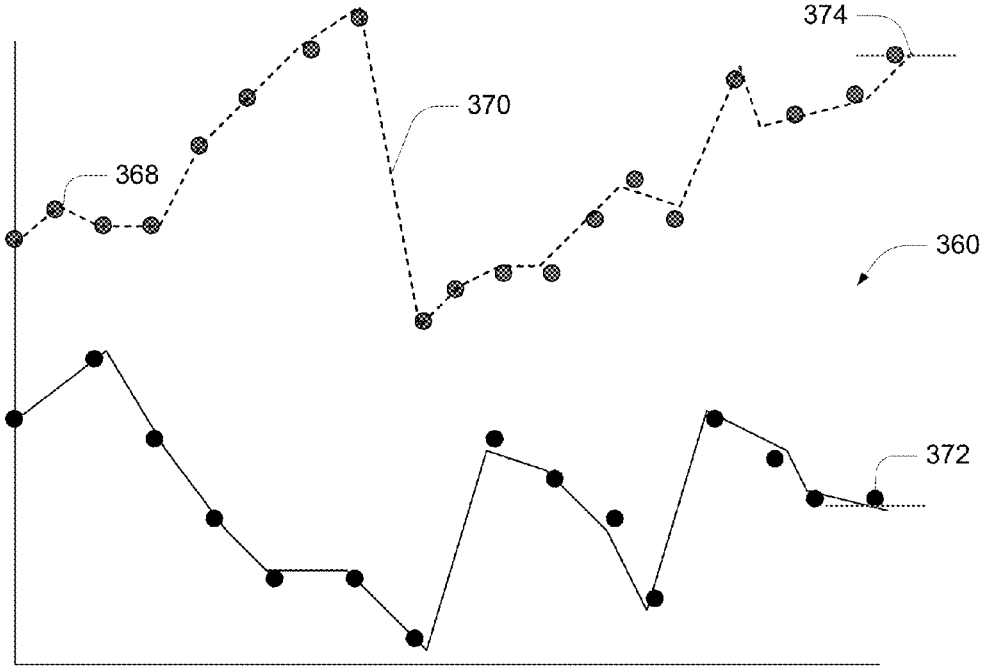
FIG. 3*c* is a graph illustrating another exemplary relationship between a series of wagering results and a series of controlled sequences for portions of an entertainment game.

FIG. 3*c* illustrates an implementation of another exemplary entertainment conditioning function through the use of a look up table included process maps used to affect the operation of an entertainment game. Turning now to FIG. 3*c*, on graph 360 dots, such as dot 362, and respective curve 364, again illustrate an RC credit meter on the game for a series of gambling or wagering results. From graph 360, it can be seen that the player has some losses and wins. Also on graph 360 dots, such as dot 368, and respective curve 370, represent a yardage meter for use in generating a display for an entertainment game. In contrast to graph 340 of FIG. 3*b*, curve 370 reflects yardage won/lost in the football game when playing to beat a point spread as the yardage is affected by an entertainment conditioning function. In FIG. 3*c*, even though the player is going to incur a margin loss 372 in terms of their wagering play, the player actually wins 374 the football game by continuing to make up yards late in the game (versus the yardage failing as shown in FIG. 3*b*). As previously described, the win of the football game could simply be a function of the RWE wagering results, the player's play picking, or a hybrid of the two. Returning to FIG. 3*c*, the player wins the football game but, as a point spread must be beat in order to "cover", the wagering result dictates that the final outcome of the entertainment game be that the football game was won by fewer points than needed to cover the point spread. So in this case, a player can experience a satisfying game session where prudent play calling and team configuration allowed the player to be a strong opponent but the player could not cover the spread. Accordingly, the final outcome of the entertainment game (that of not being able to beat the point spread), is tied to the fact that the player did not have a winning series of gambling or wagering results on the game. If, however, the player had a winning session, then the game would show an outcome of the entertainment game where the player's team had covered the spread.

Figure 3D:
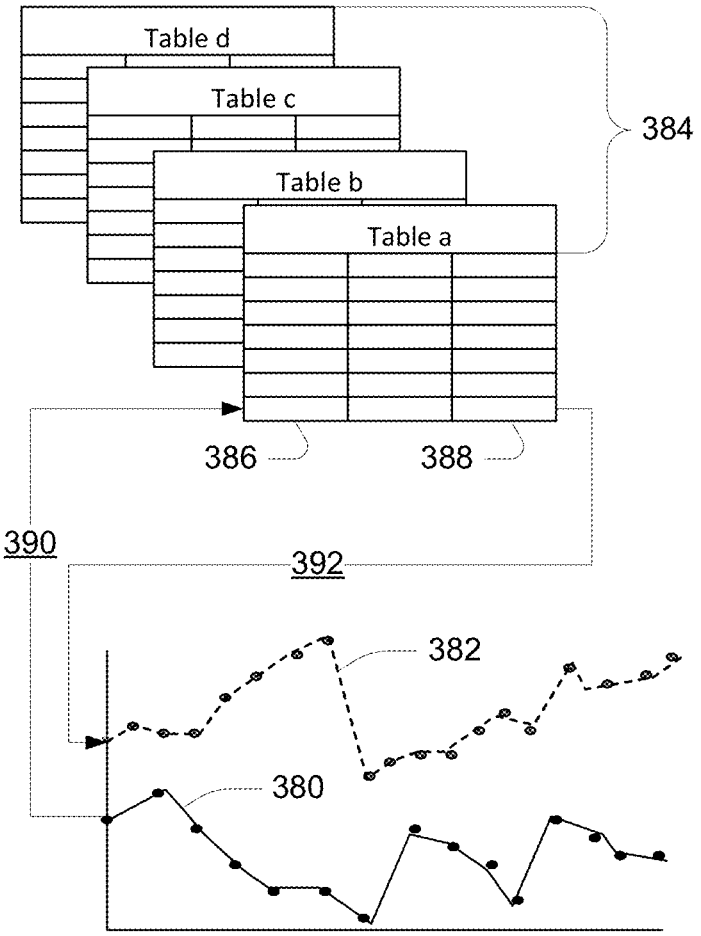
FIG. 3*d* is a diagram illustrating an exemplary entertainment conditioning function.

FIG. 3*d* illustrates another exemplary aspect of an entertainment conditioning function. As illustrated in FIG. 3*d*, an RC curve 380, representing gambling or wagering results, and a yardage curve 382, representing progress in an entertainment game, are again replicated. A series of look up tables 384, each of which has an index 386 for lookup, and corresponding entertainment game states 388 representing results for a play, which could be the net yardage for the play, or other special playback modifiers (such as false starts, penalties, etc.) that could result. Creation of the index and the selection of which table to use the index in may be a function of a number of parameters used individually or a plurality of such in a combination. A non-exhaustive list of potential parameters for index creation includes:

(a) The amount of RC remaining.
(b) Virtual time elapsed in the game context (e.g. in football, time left on the game clock)
(c) The depth of the Win/Loss Betting Queue (i.e. the amount of RWE plays available for look ahead).
(d) Game context choice or actions (e.g. which play is selected).
(e) The volatility of the RWE engine pay tables.
(f) The difference between the game context score and the required score level to beat (e.g. the spread).
(g) The difference between progress in the game context (e.g. yard gained) and the difference of the RC at the start of the game session and the current RC level.
(h) The relative rate of RC wagered by the player (i.e. the amount wagered average vs. the max bet amount for the game).
(i) A random determination.
(j) The physical amount of time elapsed in the play session.
(k) The speed at which the player plays the game.

In operation, one or more gambling or wagering results are determined for a gambling game. The one or more gambling or wagering results are then used (390) along with a look up table to generate (392) a desired result or entertainment game state that is then used to generate a controlled sequence for a portion of the entertainment game.

In another aspect, the output of the entertainment conditioning function are pseudo gambling or wagering results that are gambling or wagering results that have been conditioned according to the entertainment conditioning function. The pseudo gambling or wagering results are then used to generate a controlled sequence of a portion of an entertainment game in the same manner as non-conditioned gambling or wagering results.

Figure 3E:
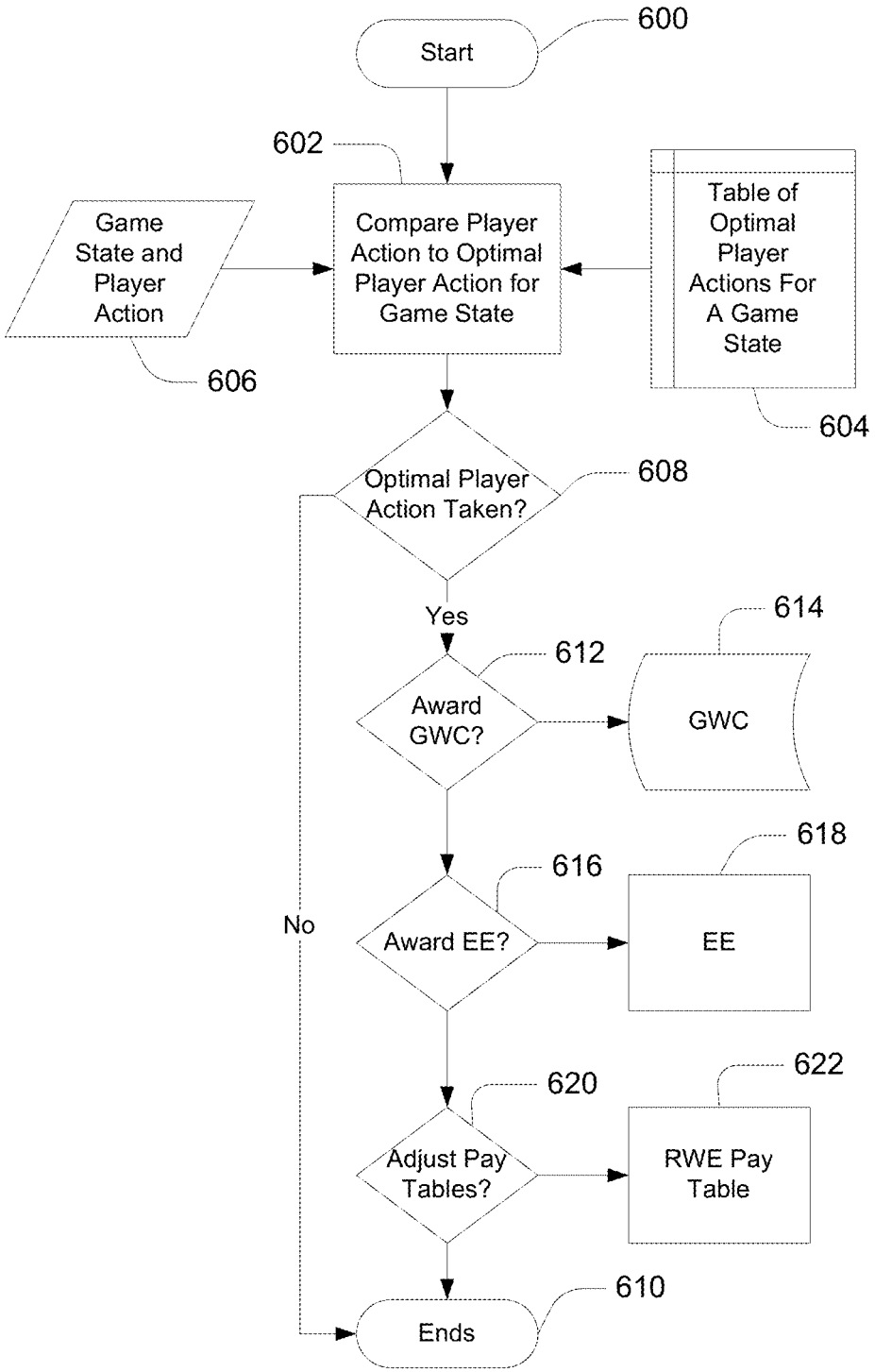
FIG. 3*e* is a process flow diagram illustrating a GWE analyzing player actions during an entertainment game.

FIG. 3*e* illustrates another process by which a player may be rewarded for playing the entertainment game well even though the gambling or wagering results are not positive for the player. In this process, a GWE (not shown) starts (600) the process by comparing (602) a player's actions while playing an entertainment game to a set of optimal player actions. To do so, the GWE receives one or more player actions taken by the player while playing the entertainment game when the entertainment game is in one or more respective entertainment game states 606. The GWE then compares the one or more player actions taken by the player with one or more optimal player actions for the entertainment game in one or more respective entertainment game states 608 stored in the GWE. For example, if the player is playing a football style entertainment game and the entertainment game is in a state where the player has to make short yardage on a $3^{rd}$ down conversion, then an optimal player action may be to call a running play.

The GWE compares (602) the action taken by the player with the optimal action for the given entertainment game state and determines (608) if the optimal action was taken. If not, the process ends (610) without rewarding the player. However, if the optimal player action was taken, the GWE determines (612) if the player should be awarded GWC 614. The GWC may also determine (616) if the player should be awarded by enhancing an EE 618 within the entertainment game. If the GWE does determine to award the player EE, the GWE does so by enhancing an EE within the entertainment game for the player's use. The GWE may also determine (620) to reward the player by adjusting a pay table 622 in an RWE to be more favorable to the player. As a result of this process, the player is rewarded for playing the entertainment game well even if a series of gambling game results may not prove favorable to the player.

Direct and Indirect Correlation of the ESE Controlled Sequence

In another aspect, the correlation between events in the entertainment layer driven by the ESE 106 and the gambling events driven by the RWE 104 can be either direct (e.g. five credits won equals a five yard movement of the football) or indirect (e.g. the GWE 102 or ESE 106 can introduce randomness into the process by which the entertainment output is selected, the random process being seeded by the result of the RWE 104 controlled gambling game and the state of the ESE 106 driven entertainment game controlled sequence.)

In the case of the indirect correlation, if the GWE 102 was the controller introducing some measure of randomness, the GWE 102 would modify the directions that it sends to the ESE 106, which in turn generates the appropriate controlled sequence of a portion of the entertainment game output for the player 114 (of FIG. 1). In this mode, a gambling or wagering result X which is achieved by the RWE 104 would in turn be modified by the GWE 102 by an amount 'Z' (e.g. X±Z) such that the display generated by the ESE 106 is not deterministic as a function of the result of the RWE 104 controlled gambling game. The nature of the modifier 'Z' could be an element which was dictated by the casino operator (not shown).

Player Communication

Figure 4A:
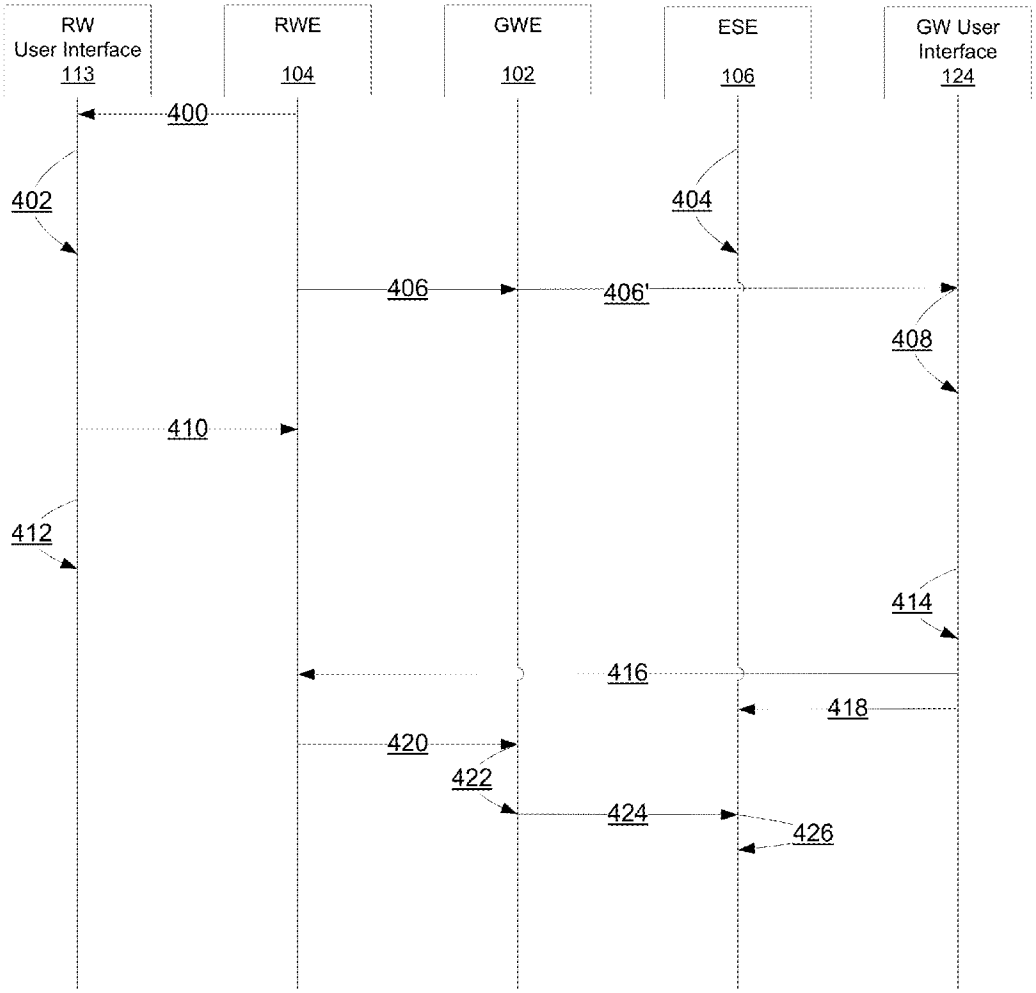
FIG. 4*a* is a sequence diagram illustrating sequencing of exemplary data flows between an RW Patron Management System, an RWE, a GWE and an ESE.

Turning now to FIG. 4*a*, in another aspect, the player's 114 (of FIG. 1) state 400 as it relates to the RWE 104 and the RWE 104 controlled gambling game is displayed (402) to the player 114 (of FIG. 1) using an optional RW User Interface 113, independently of the state of the ESE 106 driven (404) entertainment output. The number of credits in the gaming system 100 (of FIG. 1), the number of credits the player 114 (of FIG. 1) has selected to bet or wagered on the next gambling play, and any and all other metrics 406 and 406' relevant to the player's status in the RWE 104 controlled gambling game are continuously updated and displayed 408 using the RW User Interface 113, independently of the entertainment content of the game as generated by the ESE 106. This is achieved through a dedicated portion 125 (of FIG. 1) of the GW User Interface 124 that is reserved exclusively for this purpose and that is managed by the GWE 102 based on input received from the RWE 104.

The player's RWE state portion of the GWE 102 output, while synchronized with the gambling activity within the RWE 104, may not in all implementations be tightly synchronized with the ESE 106 generated entertainment game controlled sequence output (i.e. the ESE 106 output may lag the information displayed directly by the GWE 102 (if part of the particular implementation) as to the state of the RWE 104 controlled gambling game). In addition, the output of the ESE 106 (i.e. the ESE 106 generated entertainment game controlled sequence, and the GWE 102 driven output directly reflecting the state of the RWE 104 controlled gambling game, may be directly synchronized such that the result of a RWE 104 controlled gambling game is not known to the player 114 (of FIG. 1) until the completion of the ESE 106 driven display sequence initiated by that RWE 104 controlled gambling game. This characteristic may or may not be accompanied by a feature that prevents additional bets or wagers from being made until the ESE 106 driven display routine is complete and confirmation of this fact is passed from the GWE 102 to the RWE 104.

Direct RWE Control and Status Display

In another aspect, certain player functions are handled as input 410 directly to the RWE 104, rather than running through the GWE 102 or ESE 106. According to such an aspect, the player 114 (of FIG. 1) triggers the betting process in the RWE 104 through a dedicated user input portion of RW User Interface 113 connected to the RWE 104. The player 114 (of FIG. 1) can also cash out (412) through another dedicated user input linked directly to the RWE 104 through the RW User Interface 113. In another aspect, these functions are handled through a touch screen, whereby the RW User Interface 113 subsumes a portion of the display. In another aspect, all user input is captured (414) through the GWE User Interface 124, which directs the input 416 to the RWE 104 or directs the input 418 to the ESE 106, as appropriate.

Betting Queues and Story Board Control

In another aspect, player 114 (of FIG. 1) actions will result in a request to the RWE 104 to drive a number of RWE 104 plays, as exemplified by Pending Bet Queue 132 (of FIG. 1) to occur in order to generate a list of wins/losses which would be loaded into a queue. This wins/losses queue, or WLQ 420, is in turn communicated to the GWE 102. The GWE 102 operates (422) on these gambling or wagering results via the one or more Process Maps 130 (of FIG. 1), such Process Maps 130 (of FIG. 1) containing the procedures to analyze (424) the net result of the gambling or wagering results in the WLQ 420 and subsequently trigger 424 a series of actions 426 in simulating a portion of the ESE 106 controlled entertainment game by the ESE 106 such that player 114 (of FIG. 1) experiences more of a comprehensive story to describe the result of their wagering as opposed to the linear relationship of a typical wager-result, wager-result method, in the case of a single ESE 106 generated controlled sequence of a portion of an entertainment game per RWE 104 play by direct correlation. The purpose of this conditioning function that the GWE 102 processes using the WLQ 420 is to provide a more realistic ESE 106 controlled entertainment game context progression, enhancing the entertainment derived by the player 114 (of FIG. 1).

An example of this functionality in the context of a football game would be the GWE 102 determining from the WLQ 420 (which for this example has a depth of 8 plays) that the player will net a win of 3 credits for a total of 8 bet, but will only do so on the last play. The GWE 102, receiving this gambling or wagering result from the pending WLQ 420 instructs the ESE 106 to generate a controlled sequence of a portion of the entertainment game showing the players team making 2 running plays for short gains, followed by the quarterback getting sacked for a loss of 10 yards, followed by the quarterback throwing the ball downfield for a 25 yard completion and a first down.

The entertainment or storyboard conditioning function (performed by the GWE 102 for conditioning the ESE 106 output described above) may or may not directly correlate to the handling of the actual wagering proposition which RWE 104 plays entail. This is to say, if the conditioning function directly correlated to the wagering proposition, then the results of the conditioning operation of the RWE 104 results would be translated into a single summary bet or wager for the player (so long an equivalent mathematical result for a fair gambling proposition could be ensured). If the conditioning function was not directly correlated, then one of two methods could be employed: (a) the wagering proposition would be a package of RWE 104 wagers run in a sequence as a package of bets or wagers, or (b) a separate RWE 104 wager not related to the sequence of RWE 104 wagers would be effected to produce the wager proposition. The correlation and exact implementation may depend on regulatory and casino operator policies. Additionally, the WLQ 420 pending bet or wager results may or may not be considered irrevocably committed to the RWE 104 controlled gambling game. In the case where all bets or wagers in the WLQ 420 will be placed, the ESE 102 will play out the script resulting from the pending queue of bets or wagers, and the player 114 (of FIG. 1) will win/lose funds accordingly. In this mode, and at a moment of synchronization, the player 114 (of FIG. 1) would then be presented the choice to continue with the game and hence expose themselves to the next series of bets or wagers, to limit the amount of bets or wagers they'd be exposed to, or to cash-out. Note that in this WLQ 420 committed mode, the WLQ 420 could be no larger than credits available on the game, subsuming that the gaming system contains the logic to automatically control the depth of the WLQ 420 or how much of the WLQ 420 is analyzed and thus committed by the GWE 102 to the gambling proposition.

If the gaming system utilizes the WLQ 420 herein described, there are two methods for handling termination of play by the player 114 (of FIG. 1) at the time of cash out. In the first method, the player 114 (of FIG. 1) may elect to revoke the pending bets or wagers of the WLQ 420 and to take pay out on the credits remaining on the gaming system. In the second method, the pending result of bets or wagers of the WLQ 420 are displayed to the player 114 (of FIG. 1), and the amount of remaining credits which the player 114 receives at cash out is a netting of these results against the credits remaining. Which method is utilized may be a selection of the casino operator or will be based on what is allowed by gaming regulations in the particular jurisdiction.

The WLQ's 420 operation does not necessarily mean that a plurality of credits must be played or committed. For instance, the final net result of the WLQ 420 over say 9 bets or wagers could be arithmetically operated upon in some manner to determine the betting result of a single set of credit(s) wagered. The value of the WLQ 420 in this case is to provide a deeper set of inputs for the ESE 106 GW context story board so that the player 114 (of FIG. 1) is uncertain throughout a greater period of time how their bet or wager is going to come out. In another aspect, the player could commit a fixed amount of credits to the whole football game, the RWE 104 could be run once to determine the outcome of the whole game, and then the football game could be played by the player to completion, the result of plays throughout score the game controlled by the GWE 102, its Process Maps 130 and possibly RNG results for the play by play action, with the outcome of the whole game unknown until the final.

In another aspect, the WLQ 420 is eliminated, and a series of control tables in the one or more Process Maps 130 (of FIG. 1) of the GWE 102 would take an RWE 104 RNG 108 (of FIG. 1) wagering result and use the value to drive selection of a particular control table which would provide a script of instructions to drive the ESE 102 GW context story board over a multiple of plays, actions, results or events. The purpose here again is to drive a richer entertainment representation of the result of RWE 102 RW gambling plays.

In another aspect, generation of the controlled sequence portion of the entertainment game further includes using a conditioning function to relate the result of the general direction (winning or losing) of a plurality of wagers in the WLQ with the controlled sequence portion of the entertainment game, such that the result of the controlled sequence portion of the game may be decoupled on a wager by wager basis, while being coupled on a summation basis, as summed over the plurality of wagers.

ESE Output Conditioning

In another aspect, as the player 114 (of FIG. 1) continues to expend credits in the game, either in a single session, or across multiple sessions as tracked through a RW Patron Management System 128 (of FIG. 1), the ESE 106 output can be conditioned to provide audio-visual output that is exclusively displayed to the player 114 (of FIG. 1) if the player 114 (of FIG. 1) meets certain criteria as set by the casino. For example, unique characters, weapons, background scenery and/or music, monsters, etc. could be displayed in variants of the ESE 106 output. Likewise, unique gambling propositions can be offered to the player 114 (of FIG. 1) as a function of player status as reflected in the casino's RW Patron Management System 128 (of FIG. 1) and/or the player's 114 (of FIG. 1) gambling behavior during the current session. The ESE 106 output can also be conditioned, and/or unique display options provided to the player 114 (of FIG. 1), as a function of the casino's assessment of the player 114 (of FIG. 1) across any number of dimensions as supported by the RW Patron Management System 128 (of FIG. 1), independently of the player's 114 (of FIG. 1) specific actions vis-à-vis the specific game in question. In this manner, a player's entertainment experience on a particular game can vary from player to player and session to session. To enable such a feature, the gaming system (of FIG. 1) accepts input from the casino operator or configuring entity on a plurality of conditioning variables, such as rate of play, time of day, frequency of play on the particular game, a players club status, etc. Based on the control variables specified, a casino operator can tailor their machines entertainment offering to their particular market interests.

In another aspect, player selections in the ESE 106 controlled entertainment game such as selection of a team in a football game, selection of specific players for a team, selection of a specific play choice, choice of weapon or game scenario, etc., may control certain RWE 104 parameters such as the amount of credits bet in the RWE 104 controlled gambling game and/or affect the bonusing available to the player. For example, a football controlled sequence driven by the ESE 106 might allow the player to select from one of a number of offensive plays to be run. Choices might include a run up the middle, a short 5-yard pass attempt, and a 50-yard "Hail Mary" pass attempt. Selection of each play might cause one, three and ten credits to be bet or wagered in the RWE 104 controlled gambling game respectively, this information having been clearly communicated to the player prior to finalizing his selection. In another example, choosing NY Yankee™ Alexander Rodriguez to pinch hit in an ESE baseball entertainment game might require that additional credits are expended for each "at bat", but could also give the player the opportunity to win bigger bonuses. Such a scenario subsumes the concept whereby the player plays the ESE 106 controlled entertainment game and in so doing makes choices that affect the RWE 104 controlled gambling game configuration such that player choices can affect the denomination of the credit and/or the bonusing available as a function of playing the game. Once the RWE 104 is configured to operate in response to certain player choices in the ESE 106 GW context, the actual gambling play is run completely randomly on the RWE 104.

In another aspect, player selections in the ESE 106 controlled entertainment game affect the odds or pay tables of the RWE 104 controlled gambling game. For example, a player in an ESE 106 controlled football entertainment game may elect to call a long odds play, such as a "Hail Mary" pass when only 2 yards are needed and they are on the 50 yard line, versus calling a much safer run up the middle play. In this case, the RWE 104 would receive signaling as to the selection and enroll the player in a long odds bet or wager with a much higher payout than would be the case with the 2 yard up the middle run play.

In another aspect, and a feature related to that disclosed in the previous paragraph, the GWE 102 contains analysis logic and processes to determine the riskiness of the player 114 (of FIG. 1) choices in the ESE 106 controlled entertainment game, and signal the RWE 104 so as to effect changes in its pay tables or odds to match the gambling profile of the RWE 104 to the risk of the ESE 106 elected play or action choice. (E.g. calling the "Hail Mary" pass in the situation cited in the preceding paragraph, or in a shooting game, the player directing the player to run directly at a machine gun nest to engage in close combat with a pistol.)

In another aspect, the player's skill in playing the entertainment game influences the gambling game. In operation, the GWE communicates with the RWE to select and/or configure a gambling proposition as a function of the player's demonstrated skill (exclusively or in conjunction with other influencing elements) in the entertainment game. The player's demonstrated skill may be a function of their play at in the current game session (either over the entire session, in the context of a single recent action or anything in between), or a measure of a given player's demonstrated skill over time (i.e. across multiple game sessions as related to a specific player profile). The impact of the player's demonstrated skill upon the nature of the gambling game can be slight or large, the relative influence being determined by the casino operator or gaming system manufacturer.

The form of the impact can include, but is not limited to (a) the odds of the gambling game, or (b) the range of possible results.

In another aspect, it should be noted that in addition to the impacts relating to RC use cited before, various ESE 106 GW context decisions can accrete to or cause a declination of a player's GWC based on GWE 102 analysis of the wisdom of the choice in the given situation (e.g. was it wise to call for a 50 yd deep pass when 4th and 1 on the opponents 35 yard line in the football game?)

Figure 4B:
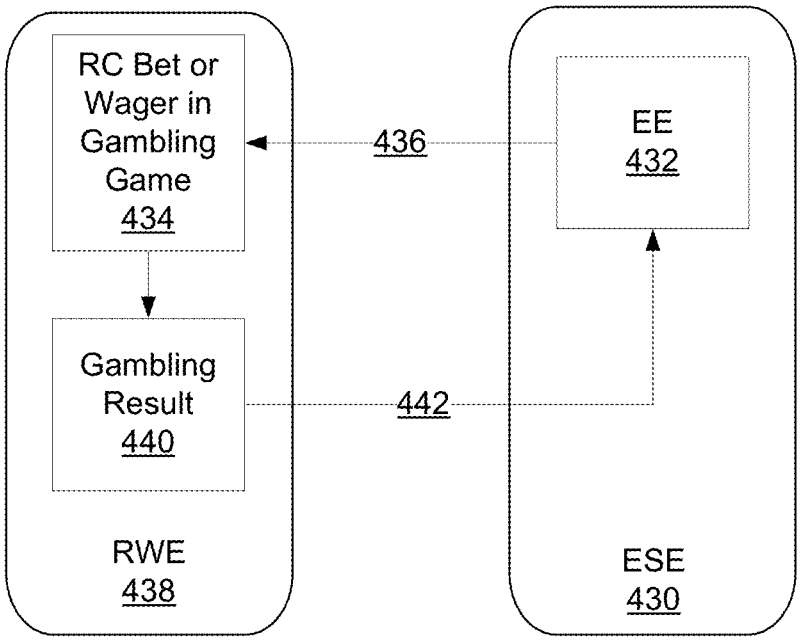
FIG. 4*b* is a data flow diagram illustrating an exemplary interaction between an RWE and an ESE.

In another aspect, a closed loop feedback between the entertainment game and the RWE operates to provide an additional play element. Referring now to FIG. 4*b*, in operation, an ESE 430 manages an EE 432 that a player uses when playing an entertainment game hosted by the ESE 432. The player consumes the EE 432 as the player plays the entertainment game. When the player takes an action that consumes the EE 432, a corresponding bet or wager 434 is made (436) in a gambling game managed by an RWE 438. A gambling RC result 440 of the gambling game is then used to determine an effect 442 for the EE 432. For example, an amount of the EE 432 may be increased if the gambling or wagering result is a win for the player. Alternatively, the EE 432 may be reduced if the gambling or wagering result is a loss for the player.

Figure 4C:
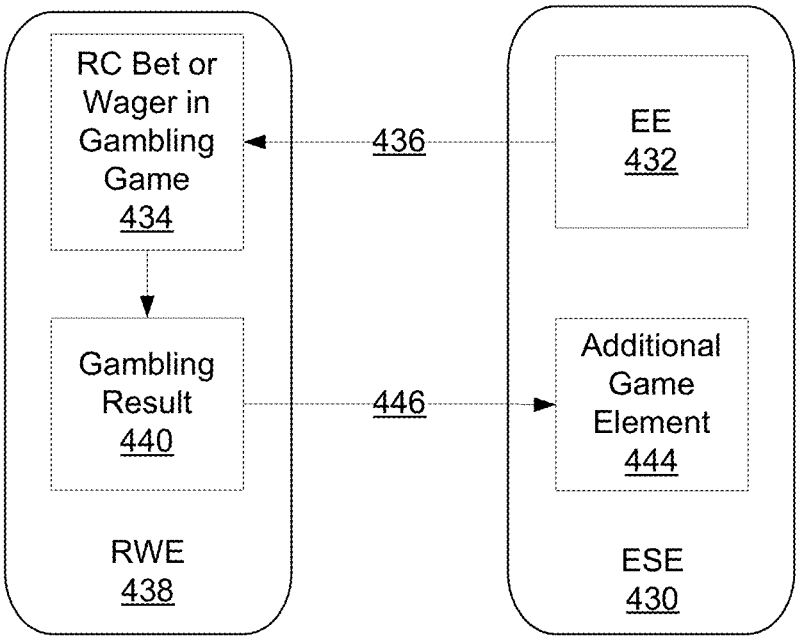
FIG. 4*c* is a data flow diagram illustrating another exemplary interaction between an RWE and an ESE.

Referring now to FIG. 4*c*, an additional entertainment game element 442, or different type of EE, may be supplied (444) to the player by the ESE 430 in response to the gambling or wagering result 440 rather than affecting the original EE 432 that was acted upon or used by the player to make (436) the corresponding bet or wager 434 in the RWE 438. Accordingly, the RC gambling or wagering result 440 of the gambling game is used to determine addition of the additional game element 442 in the entertainment game.

For example, an RC win could provide a player of a football game such as Madden Football™ with access to linebacker Lawrence Taylor as a player on his team, which in turn could positively affect the player's performance in the entertainment game and/or in the RW gambling game. This stands in contrast to a RC win leading to the opportunity to run more plays, which is an example of an increase in EE.

As another example, an RC win could provide a player in a baseball game with a higher payroll ceiling, allowing the player to sign better talent to his team. This closed loop feedback could take place in lieu of, or in addition to, an increase in the amount of EE, for example.

As another example, an RC loss could cause a player in a racing game to experience fog, making it harder to stay on the track, or place road hazards on the track (e.g. potholes) in lieu of, or in addition to impacting the amount of fuel the race car has (i.e. the EE).

Another example related to a racing game, a loss in the gambling game could cause the steering wheel control to vibrate or become less responsive to the player's inputs until a subsequent gambling game win, or a certain event occurs within the entertainment game (e.g. a prescribed period of time elapses, the player pulls his car into the pits for repairs, etc.). In this regard, the closed loop feedback described herein need not be singular, but can continue to loop back on itself over a multitude of gambling game results and/or entertainment game events.

As another example related to a hybrid game implementation of Scrabble, EE is consumed when tiles are moved from the player's rack to the board. RC is bet as a function of the points on the tiles placed (i.e. Z-O-O drives a 12 credit bet). In an RC win, in addition to affecting the player's amount of, or access to, EE, can in certain circumstances governed by the design of the game affect the Scrabble board. When an RC win of a certain threshold is reached, bonus squares are added to the Scrabble board. These squares can relate solely to the entertainment game and the accumulation of GWC (e.g. an additional "triple word score" square"), can relate to subsequent gambling games (e.g. a square that provides a free credit added to a gambling game initiated by the consumption of EE when a tile is placed on the square using a valid Scrabble move), or both.

An RC win could also increase the total number of tiles available to the game or provide special tiles (e.g. a letter "A" worth eight points instead of one point). RC losses could provide the opposite effects, eliminating special squares, or base squares that are standard on a Scrabble board, eliminating tiles, etc.

Variables within the ESE, and also inputs from the casino operator, can also play a role in establishing the relationship between EE→RC and RC→EE beyond explicit choices made by the player (e.g. the case where the player selects a specific football play or a specific player for his football team in Madden Football™)

The impact of these variables and inputs, along with all other inputs that can affect this relationship are managed through a function within the GWE—previously described.

Examples of inputs from the casino operator include, in a non-exhaustive list, time of day, location of machine, player specific information (e.g. player identity, funds expended today or over a period of time on this game or on all games in the casino in total, etc.).

As another example of an input by a casino operator, roving gaming element can be injected into the entertainment game, but only one for instance, for a whole group of networked games of the same type. The first player of the networked games that successfully played the roving gaming element would receive a jackpot win that would then become unavailable to the other players of the networked games. In the context of a first person shooter entertainment game with a western them, the roving gaming element would be in the form of a very bad hombre who would roam towns within the GW. Players, would ride from town to town, doing their gaming, but if they were both lucky (or unlucky enough) to run across this guy (he could be in a saloon, restaurant, on the street, at the corral, etc.) they could decide to play bounty hunter and "call him out" for a duel. This would be a big payout jackpot, with perhaps easy odds, so that the harder proposition might be finding the bad hombre, and maybe the player ends up with a 50/50 chance of killing the bad hombre depending on the setup (at the corral, in the open, etc.). This would be a very thematic way for a casino operator to offer a progressive jackpot. Players would actually try to hunt the bad hombre down if the award was high enough. This might mean that the bad hombre is always there in any GW that any player can access, but they may have to ride to a remote area of the territory to find him, and in an obscure place to boot (under the stairwell watching, etc.). First to kill the bad hombre, wins the money.

Such a feature allows the casino operator to program a "roving jackpot" and inject the roving jackpot into the game for a period of time. The casino operator could advertise this and make a big deal of it, such as coming to a gambling area to play for a big Texas Hold'em tournament prize.

In another aspect, a result of a gambling game shapes a parameter of the entertainment game, but not the result or a specific result. For example, in an entertainment game where a player must achieve a particular objective by overcoming a series of obstacles, the number and types of obstacles may be altered in correspondence with the result of a gambling game. Alternatively, a new and unexpectedly harder obstacle may be placed into the game. For example, in a game where the player has to chop trees, if the player wins a gambling game, the GWE process map shapes the ESE game by causing more trees to appear of various types (such as easier to chop higher point value—GWC—trees if the player wins the gambling game, fewer or no new trees if the player loses the gambling game, or a horrible beast is introduced into the forest in the event of a gambling game loss, and the player has to fend the beast off with the player's axe).

In the various aspects of the gaming system, player choices and input are received through the GWE user interface 124, which can subsume a wide array of input devices, including but not limited to a touch screen, buttons, joystick controllers, levers, switches, etc.

An advantage of the architecture is that it leverages very popular titles with "gamers" and provides a sea change environment for casinos to attract players with games that are more akin to the type of entertainment which a younger generation desires.

Another benefit of this architecture is that it minimizes the underlying changes needed to the aforementioned entertainment software (Gears of War, etc.), for it to operate within the gaming construct, thus making a plethora of complex game titles and environments rapid and inexpensive to deploy in a gambling environment.

Player Profiles and Game Influence Elements

In another aspect, a player either has an account on the gaming system or game network or they do not, as in the case of a new player. If a player is new to the network, or a player wishes to change their preferred profile, a setup process, similar to a wizard, is run. The setup process can encompass a number of parameters which alter the look-and-feel of the ESE's 106 output. For example, a player profile might identify the football team they want to be represented by in an ESE 106 controlled entertainment game system built around Madden Football 2K10.

In another aspect, a choice of a particular team in a sports themed entertainment game can affect the paytables and costs of wagering. For example, a particular team may include players that have a higher probability of carrying out a particular called play. A player playing such a team would naturally tend to have better results in the entertainment game. Therefore, it would be natural for such a team to cost more to play, that is, minimum wagers placed while utilizing such a team in the entertainment game would be higher or occur with more frequency than if a lesser team were chosen. In addition, as a reward for risking more, paytables could be adjusted so that the player has either a higher probability of winning a particular wager or the payout as multiplier of the wagered amount per successful wager could be set higher.

Having described a general architecture and processing for the gaming system 100 (of FIG. 1), several specific game aspects and processes used in the specific examples of a gaming system will now be described in reference to FIG. 1.

Western Gunfight (Single Player)

In this example implementation, the ESE's 106 entertainment game controlled sequence concerns an "old west" style gunfight where two gunfighters (one representing the player 114, the other the computer) oppose each other on the main street of a frontier town circa 1850. The player can make choices as to how his gunfighter is represented in the game (e.g. man or woman, tall or short, left-handed or right handed, mode of dress, etc.). The player can also choose the type of pistols their gunfighter is going to use. These choices are made through the GWE User Interface 124, in concert with audio-visual output created by the ESE 106. Players could, at the behest of the casino and/or as a function of their player status, gain access to specialized accessories for their gunfighter, effectively conferring status.

In the game, the number of credits bet reflects the number of rounds of ammunition available to his character in the gunfight itself. A single credit provides the character with one bullet in a single pistol. A bet or wager of 10 credits might provide the character with two pistols, each with five bullets.

When the bet or wager is placed, the result of the gambling proposition is translated by the GWE 102 and/or ESE 106 into a controlled sequence of the gunfight itself. A losing bet or wager of a single credit would lead to the player's gunfighter firing a single errant shot, and being shot by the opposing gunfighter. A draw would result in both the player's character and the opponent missing each other, or injuring each other, but not fatally. A winning bet or wager of seven credits, for example, might lead to a prolonged audio-visual output in the form of a more involved gun battle, where the two characters move around the street until they expend all of their ammunition (in this case seven bullets for the player's character). At the completion of this logical display unit, the opponent would die and the player's character would survive more or less unscathed.

In another aspect, the game would always have the opposing character loading their gun with six bullets for a showdown (as one would typically expect). The player, by selecting to load less bullets for the gun fight, would be interpreted by the GWE 102 to be a riskier proposition for the player 114, and as such the GWE 102 would signal the RWE 104 to select a longer odds bet or wager pay table with larger payout potential than if the player 114 fully loaded their gun with six bullets. The gun battle would ensue and if the result of the RWE 104 controlled gambling game was a win for the player 114, the player 114 would see his/her character shooting deftly only say the two bullets they had loaded short versus their opponent who wildly fanned their six gun missing the player 114 with their shots. If the RWE 104 controlled gambling game was a loss, the player 114 would see the more expected outcome whereby they ran out of ammo in the fight, or shot at too slow of a rate and were gunned down in the street.

The player's gunfighter would win and lose gun battles, but would not be fatally injured until such time as he expended the last credit in the machine, and such final bet or wager was a loss. At that time the GWE 102/ESE 106 driven audio-visual displays would encourage the player 114 to insert more credits or money to continue play and to prevent his gunfighter from dying a slow painful death from complications related to his gunshot wound.

In another aspect, a player could save the configuration of their gunfighter character for future use. This configuration would be linked to their account on the casino's Patron Management System and could be accessed in subsequent game playing sessions.

In another aspect, a player can accumulate GWC while playing the gunfighter game, thus allowing a player's character to gain in skill as function of winning more gunfights and therefore, gaining access, for example, to better odds for a bet or wager as a function of the player's GWC level (in this case akin to how many gun battles the player has won). In addition, GWC can be accumulated by the player for making certain decisions during playing of the entertainment game as opposed to making other decisions. For example, a player may be accorded GWC for making a selection as to what to use for cover on the street, selecting a less powerful but more accurate weapon, etc.

As a player continued play in the game, they would experience a range of interesting opponents. Bonuses that might be won as a function of the RWE 104 controlled gambling game could be represented in the entertainment game controlled sequence as the gunfighter having come across stolen loot, or winning a game of cards in a saloon, or stripping a vanquished opponent of his personal effects.

Note that this example is not intended to be all inclusive, but rather cites only one manner in which the various components of the gaming system may be combined to accomplish an entertainment and gambling game.

Baseball (Single Player)

In this example implementation, gambling is undertaken in the context of a baseball game. The game proceeds, bet by bet, or wager by wager, through nine innings, including both halves, where the player's team is on offense and on defense. In another aspect, the player 114 can choose to play only offense, the computer controlled opponents' offensive half of each inning being represented simply as a final result.

Players would be able to choose the team that they were going to be represented by, and could also in some gaming systems select specific players to represent them. Specific baseball players would require different amounts of credits to be bet or wagered for each pitch of their at bat, or in the case of pitchers, for each pitch thrown.

Within the workings of the game, for each bet or wager placed when at bat (in this example, the player 114 does not vary the size of his bet or wager for each at-bat; it is dictated as a function of the team and/or individual players he selected at the onset of the game) a pitch is thrown to their player and the player 114 either gets a hit (if the RWE 104 controlled gambling game had produced a win), receives a strike (a loss), or a ball (a draw). In the case of hits, the magnitude of the hit (single, double, etc.) is a function of the value of the gambling proposition driven win on the bet or wager made (i.e. 1× the bet or wager, 2× the bet or wager, etc.).

Ultimately, over the course of many bets or wagers, the opposing side is retired, and the player's team will then take the field to play defense. Here, bets or wagers made drive pitches by the player's team and ultimately outs, hits, walks, etc. by the ESE 106 generated opponent result. Betting continues until the opposing side is retired.

This process can continue through a full nine innings of baseball or end prematurely when the player 114 declines to expend more credits. Bonuses can be awarded at the end of the game if the player's team wins the ESE 106 generated baseball game. Given the number of credits required to reach the end of the game, these bonuses could be significant.

Note that in this implementation the cumulative effect of each bet or wager can lead to an outcome (winning or losing the baseball game) that is not explicitly linked to the result of each bet or wager and that the player 114 cannot predict. This adds an entertainment element to the slot machine that is unique and can drive long-term interest among casino customers.

In another aspect, the outcome of the baseball game need not be deterministically set by a gambling result. For example, the baseball game could still be played as is done on an interactive gaming system, such as a Wii™, namely, the player has to hit the ball, etc., but the result of the gambling game affects the likelihood of hitting the ball out of the park, or the speed that the pitch is thrown, etc.

In another aspect, accumulation of GWC during an individual gaming session affects odds in future gaming sessions if the person playing the game plays again. For example, by continuing to play games through a simulated season, accumulation of GWC over several gaming sessions would correlate to keeping a team together. Through accumulation of GWC, a more favorable TABLE Ln-RC is used to improve the probability that the player will have winning gambling or wagering results.

Note that this example is not intended to be all inclusive, but rather cites only one manner in which the various components of the gaming system may be combined to accomplish an entertainment and gambling game.

Football (Single Player)

In another aspect, gambling is undertaken in the context of a football game. The game proceeds, play-by-play through as many as four quarters (plus OT potentially) of football.

When playing offense, the patron would select specific plays to be run. Each play would correspond to a specific bet or wager value. For example, a run up the middle might take a single credit, while a 50-yard Hail Mary pass attempt might require 10 credits.

Players would be able to choose the team that they were going to be represented by, and could also in some gaming systems select specific football players to populate their team. Specific football players would modify the number of credits to be bet or wagered on a given football play. For example, selecting a pass play with Minnesota Vikings™ receiver Randy Moss as the recipient would require an additional two credits be expended in the RWE 104 controlled gambling game. Having Tom Brady of the New England Patriots™ involved in a passing play might require a one credit step-up. It is also possible that selecting specific players would provide the player 114 with access to specific bonusing provisions.

After selecting a play, the RWE 104 controlled gambling game would run in the context of the number of credits dictated by the choice of football play and the player 114 or players engaged in the play. The result of the RWE 104 controlled gambling game, as dictated by the RWE 104, is communicated to the GWE 102, and after conditioning through one or more Process Maps 130, drives a specific result through the ESE 106. The result of the gambling proposition and the outcome of the football play are both displayed to the player 114.

As the game progresses, the ESE 106 presents the player 114 with appropriate football play choices based upon the state of the game (e.g. punting the ball is not offered on anything other than fourth down).

Ultimately, over the course of many bets or wagers, an offensive series reaches its logical conclusion with points being scored, a turnover or other change of possession. The player then selects defensive formations in the context of the entertainment game controlled sequence, again driving bets or wagers of specific size in the RWE 104 controlled gambling game.

This process can continue through four quarters of football or end prematurely when the player 114 declines to expend more credits. Bonuses can be awarded at the end of the game if the player 114's team wins the ESE 106 generated football game. Given the number of credits required to reach the end of the game, these bonuses could be significant.

Note that this example is not intended to be all inclusive, but rather cites only one manner in which the various components of the gaming system may be combined to accomplish an entertainment and gambling game.

Tank Game (Single Player)

In this example implementation, gambling is undertaken in the context of a WWII tank battle. Via the GWE User interface 124, and responding to prompts generated by the ESE 106 audio-visual output, the player 114 selects one or more tanks and assigns them various attributes in terms of speed, maneuverability, range, armor and weapons. Each choice imputes a specific number of credits that will subsequently be bet in the RWE 104 controlled gambling game. The player outfits one or more tanks (representing a minimum of one credit—a single, meagerly outfitted tank—or multiple credits in the form of a single, well outfitted tank or multiple tanks each outfitted uniformly or differently) to build out his tank brigade. These tanks are staged in a corral as represented through the ESE 106 as part of the entertainment game controlled sequence. Once outfitted, the player 114 launches one or more of these tanks into battle which triggers the appropriate number of credits to be bet or wagered in the RWE 104 controlled gambling game.

The result of the RWE 104 controlled gambling game is then communicated from the RWE 104 to the GWE 102 which in turn coordinates a controlled sequence of the tank battle between the player's brigade and an ESE 106 controlled opponent. The result of the battle itself reflects (though not necessarily directly) the result of the RWE 104 controlled gambling game. As the battle progresses, the player 114 can continue to outfit new tanks and release them from the corral into battle. This again correlates with the placement of a bet or wager of a specific number of credits in the RWE 104 controlled gambling game.

For example, a player could create three tanks, correlating to three, six and ten credits respectively. These tanks are stored in the corral. When the player 114 releases the three credit tank into battle via the GWE user interface 124, a three credit bet or wager is made in the RWE 104 controlled gambling game. The result of this bet or wager dictates (not necessarily deterministically) the fate of the tank in the ESE 106 controlled entertainment game. In this example, the RWE 104 controlled gambling game results in a three credit loss for the player 114, and the tank is hit by an anti-tank missile and burns to the ground. The player then releases both the six- and ten-credit tanks into the field of battle. The RWE 104 executes both RWE 104 controlled gambling games and the results are again transmitted to the GWE 102 and ultimately affects the ESE's 106 representation of the result of these tanks' performance on the field of battle. Ultimately, if one of the player's tanks is the last remaining on the ESE 106 controlled entertainment game's field of play, the player 114 wins the ESE 106 generated tank game. This may cause the player 114 to receive a bonus but does not affect the number of credits ultimately won by the player 114. That is dictated solely by the RWE 104 controlled gambling game.

Note that this example is not intended to be all inclusive, but rather cites only one manner in which the various components of the gaming system may be combined to accomplish an entertainment and gambling game.

Internet Vs. Physically Based Casino Play

Consistent with various discussions in this document, the gaming system may be embodied in whole or in part in the "cloud" being based in the internet thus taking place outside of a casino. In this mode, players would access games through an internet website and have an otherwise similar experience as relates to RC and GWC. Tournament play would also be supported in such a model. In summary, as it would apply to the gaming system, the only notable difference between a land based casino and an internet based one would be whether players are present in a gambling operation location in the case of a land based operation, or at home or other distributed location in the case of the internet based operation. In either case, the elements of the gaming system and their functions would operate effectively the same.

Head-to-Head Play

In another aspect the gaming system also includes the concept whereby players can independently gamble through the RWE 104, but experience a head-to-head presentation of the ESE 106 driven entertainment game controlled sequence content. According to this aspect, players opt to participate in a head-to-head competition through a GWE 102 managed sign-up process. That process allows two or more (as may be appropriate given the entertainment game in question, i.e. the limit is two players for football, but could be N players for the adaptation of a multi-player game like Halo™) players to directly establish a head-to-head pairing between them, or for a single player to request a head-to-head competition. In the latter case the GWE 102 will interact with a centralized server to link the player 114 with another player in a queue of players seeking head-to-head game play. This sign-up process may, but does not have to, require minimum bet or wager commitments on the part of the players to ensure a game of adequate length between the participants.

Players gamble through independent RWEs, and there is no co-mingling of their gambling or wagering results. There is no head-to-head element with respect to the actual gambling proposition. Where the head-to-head aspect does come into play is as regards the ESE 106 display routines, and the GWE's 102 direction of same.

In a head-to-head implementation a single GWE 102 and ESE 106, either locally or on a remote server, act as a master controller. One or more Process Maps 130 dictate the impact of each player's gambling upon the players' characters within the ESE 106 driven entertainment game controlled sequence. The same resulting audio-video feed is displayed on all the slot machines of participating players. An example of such a map, for a western gun fighting game is as follows. In the table, "Character 1" is the entertainment game avatar related to player 1 and "Character 2" is the entertainment game avatar related to player 2.

TABLE 1

| Player 1 Gambling Result | Player 2 Gambling Result | Impact on Character 1 | Impact on Character 2 |
|---|---|---|---|
| WIN | WIN | Hit by shot from Character 2 | Hit by shot from Character 1 |
| WIN | LOSE | Shot from Character 2 Misses | Hit by shot from Character 1 |
| LOSE | WIN | Hit by shot from Character 2 | Shot from Character 1 Misses |
| LOSE | LOSE | Shot from Character 2 Misses | Shot from Character 1 Misses |

As with non head-to-head games, in this example, a player's character dies when the player 114 runs out of credits as a result of a losing bet or wager.

A range of bonus schemes are possible in this environment. According to one aspect, a player gains bonuses (either credits or other prizes as dictated by the casino) as a function of the player's gambling or wagering results independent of the head-to-head play (i.e. "independent bonusing"). In another aspect, each player, in addition to their gambling or wagering results, is assigned a score or GWC, in the context of the ESE 106 displayed entertainment game controlled sequence that relates to their performance relative to the player 114 they are competing with head-to-head (i.e. "relative scoring"). Continuing with the western gunfighter example, relative scoring might work like this.

TABLE 2

| Player 1 Gambling Result | Player 2 Gambling Result | Player 1 Bonus Score | Player 1 Bonus Score |
|---|---|---|---|
| WIN | WIN | 0 | 0 |
| WIN | LOSE | 1 | 0 |
| LOSE | WIN | 0 | 1 |
| LOSE | LOSE | 0 | 0 |

The bonus scoring would be tracked within the GWE 102 overseeing the head-to-head competition and would be either communicated directly to a patron management system or relayed to a patron management system through the RWE 104 associated with each player participating in the competition.

Another example of a head-to-head competition revolves around an ESE 106 deployment of a video football game (e.g. Madden Football 2K11™). In this case, head-to-head competition is limited to two players. Each selects the team they want to be, and the head-to-head competition itself is managed as described previously. Specifically, the Process Map for a head-to-head football game might look like this for example when the "offense" has the ball and it is first, second or third down.

TABLE 3

| "Offense" Player 1 Gambling Result | "Defense" Player 2 Gambling Result | Result of Play (not a $4^{th}$ down kicking situation) |
|---|---|---|
| WIN | WIN | Offense advances the ball, but does not gain a first down |
| WIN | LOSE | Offense advances the ball and gains a first down |
| LOSE | WIN | Offense has a loss of yards on the play |
| LOSE | LOSE | Offense achieves zero yards on the play |

On fourth down, in a kicking situation (this context being established by the ESE 106), the table might look like this.

TABLE 4

| "Offense" Player 1 Gambling Result | "Defense" Player 2 Gambling Result | Result of 4th Down Kicking Play |
|---|---|---|
| WIN | WIN | Offense succeeds in getting off a punt of average distance and the resulting kick return is also average |
| WIN | LOSE | Offense runs a trick play and gains a first down (50% of time) or offense achieves a punt that pins the other team deep in their zone (50% of the time) |
| LOSE | WIN | Offense gets off a poor punt (90% of the time) or the punt is blocked (10% of the time) |
| LOSE | LOSE | Offense succeeds in getting off a punt of average distance and the resulting kick return is also average |

The head-to-head implementation of the gaming system contains a richer series of one or more Process Maps 130 that are managed by the GWE 102 and ESE 106 to provide a rich gaming experience.

Bonusing schemes in the football context are derived directly from the score of the ESE 106 simulated video football game, which in turn represents the aggregate performance of the two teams as a function of each player's gambling or wagering results as transformed through the Process Map into specific football plays.

In regards to head-to-head play, generally the same concepts of queuing of bets or wagers or wagers in a Pending Bet Queue 132 of the WLQ 420 (of FIG. 4) or the absence of the WLQ 420 (of FIG. 4) would apply. When the WLQ 420 (of FIG. 4) is supported in head-to-head play, players are required to commit credits and these credits are queued in the form of pending bets or wagers to provide for smooth play. In the absences of a WLQ 420 (of FIG. 4), players would manually make betting decisions, move by move.

Figure 5:
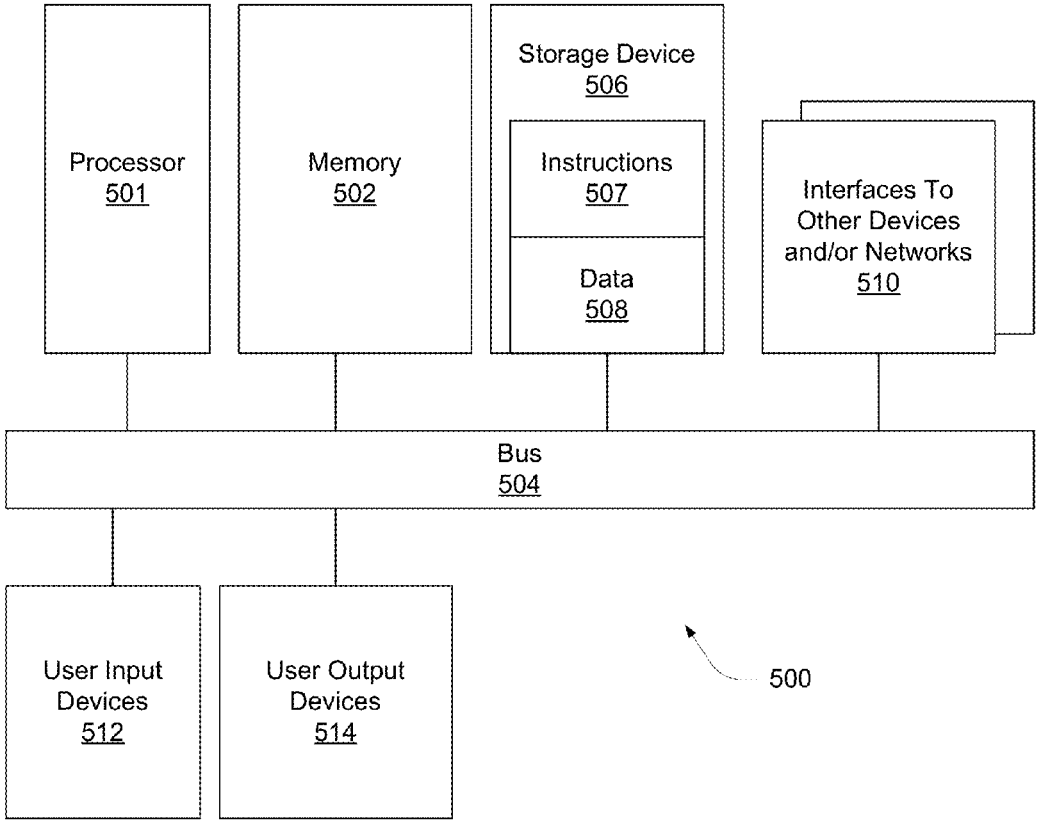
FIG. 5 is a hardware architecture diagram of an exemplary processing apparatus that may be used to host a gaming system or portions of the gaming system.

FIG. 5 is a hardware architecture diagram of a processing apparatus 500, such as a computing device, controller, general purpose computer, gaming machine or the like, that may be used to host various components of a gaming system as previously described herein. A processor 501 is coupled to a memory 502 by a bus 504. The processor is also coupled to a non-transitory processor-readable storage device 506 that stores processor-executable instructions 507 and data 508. The processor is also coupled to one or more interfaces 510 that connect the processor to other processing apparatuses as well as networks as previously described herein. The processor is also coupled via the bus to user input devices 512 and user output devices 514.

In operation, the processor 501 loads instructions 507 and data 508 into memory 502 and executes the instructions and operates on the data to implement the features of the components of a gaming system as described herein. The processor uses the user input devices 512 and user output devices 514 in accordance with the instructions and data in order to create and operate user interfaces for players, casino operators, owners, etc. as previously described herein.

It should be understood that although the processing apparatus 500 is described herein as being constructed from processor instructions stored and executed by hardware components, the processing apparatus can be composed of only hardware components. In addition, although the storage device 506 is described as being coupled to the processor through a bus, those skilled in the art of processing apparatuses will understand that the storage device could include removable media such as a USB memory device, an optical CD ROM, magnetic media such as tape or disks, etc. In addition, the storage device could be accessed through one of the interfaces 510 or over a network. Furthermore, any of the user input devices 512 or user output devices 514 could be coupled to the processor via one of the interfaces or over a network. In addition, although a single processor is described, those skilled in the art will understand that the processor could be a controller or other computing device or a separate computer as well as be composed of multiple processors or computing devices.

It should also be understood that an RWE, a GWE and an ESE as described herein can be implemented on multiple processing apparatuses, whether dedicated, shared or distributed in any combination thereof, or may be implemented on a single processing apparatus. In addition, while certain aspects and features of a gaming system described herein have been attributed to an RWE, a GWE or an ESE, these aspects and features may be implemented in a hybrid form where any of the features or aspects may be performed by any of an RWE, a GWE or an ESE within a gaming system.

According to other aspects of a gaming system as contemplated by the present disclosure, a gaming system may be implemented using a computer processor such as a single core or multi-core central processing unit (CPU) or microprocessing unit (MPU), which is constructed to realize the functionality described above. The computer processor might be incorporated in a stand-alone apparatus or in a multi-component apparatus, or might comprise multiple computer processors which are constructed to work together to realize such functionality. The computer processor or processors execute a computer-executable program (sometimes referred to as computer-executable instructions or computer-executable code) to perform some or all of the above-described functions. The computer-executable program may be pre-stored in the computer processor(s), or the computer processor(s) may be functionally connected for access to a non-transitory computer-readable storage medium on which the computer-executable program or program steps are stored. For these purposes, access to the non-transitory computer-readable storage medium may be a local access such as by access via a local memory bus structure, or may be a remote access such as by access via a wired or wireless network or Internet. The computer processor(s) may thereafter be operated to execute the computer-executable program or program steps to perform functions of the above-described embodiments.

According to additional aspects of a gaming system as contemplated by the present disclosure, a gaming system by implemented using methods in which the functionality described above is performed by a computer processor such as a single core or multi-core central processing unit (CPU) or micro-processing unit (MPU). As explained above, the computer processor might be incorporated in a stand-alone apparatus or in a multi-component apparatus, or might comprise multiple computer processors which work together to perform such functionality. The computer processor or processors execute a computer-executable program (sometimes referred to as computer-executable instructions or computer-executable code) to perform some or all of the above-described functions. The computer-executable program may be pre-stored in the computer processor(s), or the computer processor(s) may be functionally connected for access to a non-transitory computer-readable storage medium on which the computer-executable program or program steps are stored. Access to the non-transitory computer-readable storage medium may form part of the method of the embodiment. For these purposes, access to the non-transitory computer-readable storage medium may be a local access such as by access via a local memory bus structure, or may be a remote access such as by access via a wired or wireless network or Internet. The computer processor(s) is/are thereafter operated to execute the computer-executable program or program steps to perform functions of the above-described embodiments.

The non-transitory computer-readable storage medium on which a computer-executable program or program steps are stored may be any of a wide variety of tangible storage devices which are constructed to retrievably store data, including, for example, any of a flexible disk (floppy disk), a hard disk, an optical disk, a magneto-optical disk, a compact disc (CD), a digital versatile disc (DVD), micro-drive, a read only memory (ROM), random access memory (RAM), erasable programmable read only memory (EPROM), electrically erasable programmable read only memory (EEPROM), dynamic random access memory (DRAM), video RAM (VRAM), a magnetic tape or card, optical card, nanosystem, molecular memory integrated circuit, redundant array of independent disks (RAID), a nonvolatile memory card, a flash memory device, a storage of distributed computing systems and the like. The storage medium may be a function expansion unit removably inserted in and/or remotely accessed by the apparatus or system for use with the computer processor(s).

Although certain specific aspects of gaming systems have been described herein, many additional modifications and variations would be apparent to those skilled in the art. It is therefore to be understood that the gaming systems may be practiced otherwise than as specifically described. Thus, it is understood that the scope of the appended claims is not limited to the above-described embodiments and that various changes and modifications may be made without departing from the scope of the claims.

What is claimed is:

1. A method of operating a gaming system, comprising:

receiving by the gaming system, a first request for a first wager for a first player of an entertainment game, the first request being triggered by a first player action taken by the first player while playing the entertainment game in head-to-head competition with a second player;

receiving by the gaming system, a second request for a second wager for the second player of the entertainment game, the second request being triggered by a second player action taken by the second player while playing the entertainment game in head-to-head competition with the first player;

establishing by the gaming system a first wager result for the first wager and a second wager result for the second wager;

generating by the gaming system, based on the first wager result and the second wager result, a controlled sequence of a portion of the entertainment game, the controlled sequence changing the state of the entertainment game as the entertainment game is being played by the first player and the second player; and providing by the gaming system, a bonus of game world credit to one player of the first player and the second player on the basis of a relative score between the first wager result and the second wager result, whereby the first player and the second player gain bonuses relative to their related performance.

2. The method of claim 1, wherein the controlled sequence of the portion of the entertainment game is generated further on the basis of the first player's actions and the second player's actions in playing the entertainment game.

3. The method of claim 1, wherein the controlled sequence portion of the entertainment game is further based on an action of an operator of the gaming system.

4. The method of claim 1, wherein the first wager and the second wager are included in a wagering queue with other wagers, wherein the gaming system establishes a result for each wager in the wagering queue, and wherein the gaming system generates the controlled sequence portion of the entertainment game using the results of the wagers in the wagering queue.

5. The method of claim 4, wherein generation of the controlled sequence portion of the entertainment game further includes a conditioning function to relate the result of at least one wager in the wagering queue with the controlled sequence portion of the entertainment game.

6. The method of claim 5, wherein the generation of the controlled sequence portion of the entertainment game further includes using the conditioning function to relate the result of the general direction of win or loss of the wagers in the wagering queue with the controlled sequence portion of the entertainment game, whereby the result of the controlled sequence portion of the game is decoupled on a wager by wager basis, while still being coupled on a summation basis as summed over the wagers.

7. The method of claim 1, further comprising providing by the gaming system, a first bonus in credits to the first player and providing by the gaming system, a second bonus in credits to the second player on the basis of the first wager result and the second wager result, respectively, whereby the first player and second player gain bonuses independently.

8. A gaming system, comprising:

one or more processors; and memory coupled to the one or more processors, the memory storing processor instructions, where execution of the instructions by the one or more processors causes the one or more processors to perform a process comprising:

receiving by the gaming system, a request for a first wager for a first player of an entertainment game, the request being triggered by a first player action taken by the first player while playing the entertainment game in head-to-head competition with a second player;

receiving by the gaming system, a request for a second wager for the second player of the entertainment game, the request being triggered by a second player action taken by the second player while playing the entertainment game in head-to-head competition with the first player;

establishing by the gaming system a first wager result for the first wager and a second wager result for the second wager;

generating by the gaming system, based on the first wager result and the second wager result, a controlled sequence of a portion of the entertainment game, the controlled sequence changing the state of the entertainment game as the entertainment game is being played by the first player and the second player; and providing by the gaming system, a bonus of game world credit to one player of the first player and the second player on the basis of a relative score between the first wager result and the second wager result, whereby the first player and the second player gain bonuses relative to their related performance.

9. The gaming system of claim 8, wherein the controlled sequence of the portion of the entertainment game is generated further on the basis of the first player's actions and the second player's actions in playing the entertainment game.

10. The gaming system of claim 8, wherein the controlled sequence portion of the entertainment game is further based on an action of an operator of the gaming system.

11. The gaming system of claim 8, the instructions further comprising:

including by the gaming system, the first wager and the second wager in a wagering queue with other wagers;

establishing by the gaming system, a result for each wager in the wagering queue, wherein generating the controlled sequence portion of the entertainment game by the gaming system further includes using the results of the wagers in the wagering queue.

12. The gaming system of claim 11, wherein generation of the controlled sequence portion of the entertainment game further includes using, by the gaming system, a conditioning function to relate the result of at least one wager in the wagering queue with the controlled sequence portion of the entertainment game.

13. The gaming system of claim 12, wherein the generation of the controlled sequence portion of the entertainment game further includes using, by the gaming system, the conditioning function to relate the result of the general direction of win or loss of the wagers in the wagering queue with the controlled sequence portion of the entertainment game, whereby the result of the controlled sequence portion of the game is decoupled on a wager by wager basis, while still being coupled on a summation basis as summed over the wagers.

14. The gaming system of claim 8, the instructions further comprising providing by the gaming system, a first bonus in credits to the first player and providing by the gaming system, a second bonus in credits to the second player on the basis of the first wager result and the second wager result, respectively, whereby the first player and second player gain bonuses independently.

15. A non-transitory machine readable medium storing processor instructions, where execution of the instructions by one or more processors causes the one or more processors to perform a process comprising:

receiving a first request for a first wager for a first player of an entertainment game, the first request being triggered by a first player action taken by the first player while playing the entertainment game in head-to-head competition with a second player;

receiving a second request for a second wager for the second player of the entertainment game, the second request being triggered by a second player action taken by the second player while playing the entertainment game in head-to-head competition with the first player;

establishing by the gaming system a first wager result for the first wager and a second wager result for the second wager;

generating by the gaming system, based on the first wager result and the second wager result, a controlled sequence of a portion of the entertainment game, the controlled sequence changing the state of the entertainment game as the entertainment game is being played by the first player and the second player; and providing by the gaming system, a bonus of game world credit to one player of the first player and the second player on the basis of a relative score between the first wager result and the second wager result, whereby the first player and the second player gain bonuses relative to their related performance.

16. The non-transitory machine readable medium of claim 15, wherein the controlled sequence of the portion of the entertainment game is generated further on the basis of the first player's actions and the second player's actions in playing the entertainment game.

17. The non-transitory machine readable medium of claim 15, wherein the controlled sequence portion of the entertainment game is further based on an action of an operator of the gaming system.

18. The non-transitory machine readable medium of claim 15, wherein the first wager and the second wager are included in a wagering queue with other wagers, wherein the gaming system establishes a result for each wager in the wagering queue, and wherein the gaming system generates the controlled sequence portion of the entertainment game using the results of the wagers in the wagering queue.

19. The non-transitory machine readable medium of claim 18, wherein generation of the controlled sequence portion of the entertainment game further includes a conditioning function to relate the result of at least one wager in the wagering queue with the controlled sequence portion of the entertainment game.

20. The non-transitory machine readable medium of claim 19, wherein the generation of the controlled sequence portion of the entertainment game further includes using the conditioning function to relate the result of the general direction of win or loss of the wagers in the wagering queue with the controlled sequence portion of the entertainment game, whereby the result of the controlled sequence portion of the game is decoupled on a wager by wager basis, while still being coupled on a summation basis as summed over the wagers.

21. The non-transitory machine readable medium of claim 15, further comprising providing by the gaming system, a first bonus in credits to the first player and providing by the gaming system, a second bonus in credits to the second player on the basis of the first wager result and the second wager result, respectively, whereby the first player and second player gain bonuses independently.

* * * * *